US007770882B2

(12) United States Patent
Schum

(10) Patent No.: US 7,770,882 B2
(45) Date of Patent: Aug. 10, 2010

(54) APPARATUS AND METHOD FOR PROCESSING SHEETS

(75) Inventor: Michael Schum, Cherry Hill, NJ (US)

(73) Assignee: Wind Hill Concepts LLC, Cherry Hill, NJ (US)

( * ) Notice: Subject to any disclaimer, the term of this patent is extended or adjusted under 35 U.S.C. 154(b) by 82 days.

(21) Appl. No.: 12/124,789

(22) Filed: May 21, 2008

(65) Prior Publication Data

US 2008/0290581 A1 Nov. 27, 2008

Related U.S. Application Data

(60) Provisional application No. 60/939,349, filed on May 21, 2007.

(51) Int. Cl.
*B65H 5/08* (2006.01)

(52) U.S. Cl. ..... 271/11; 271/10.09; 271/97; 414/796; 414/796.2

(58) Field of Classification Search ..... 271/11, 271/10.09, 97, 98, 112; 414/796, 796.2
See application file for complete search history.

(56) References Cited

U.S. PATENT DOCUMENTS

| | | | | |
|---|---|---|---|---|
| 4,978,113 | A | 12/1990 | McAuley et al. | |
| 5,154,407 | A | 10/1992 | Shidara | |
| 5,722,811 | A * | 3/1998 | Schum et al. | 414/796 |
| 5,984,622 | A * | 11/1999 | Schum et al. | 414/796 |
| 6,481,953 | B1 * | 11/2002 | Michel et al. | 414/796 |
| 6,619,652 | B2 * | 9/2003 | Belec | 271/82 |
| 6,698,748 | B1 | 3/2004 | Crowley | |
| 6,769,678 | B2 | 8/2004 | Hobbs | |
| 6,776,409 | B2 | 8/2004 | Cook | |
| 2002/0084571 | A1 * | 7/2002 | Belec | 271/11 |
| 2002/0185803 | A1 * | 12/2002 | Belec | 270/52.02 |
| 2007/0023989 | A1 | 2/2007 | Dopfer et al. | |

FOREIGN PATENT DOCUMENTS

| | | |
|---|---|---|
| JP | 06-088732 | 11/1994 |
| JP | 2007-126247 | 5/2007 |
| KR | 10-1994-0009452 | 10/1994 |
| KR | 10-1995-0012654 | 10/1995 |

OTHER PUBLICATIONS

Written Opinion dated Oct. 9, 2008 from PCT/US2008/064358.
International Search Report dated Oct. 9, 2008 from PCT/US2008/064358.

* cited by examiner

*Primary Examiner*—David H Bollinger
(74) *Attorney, Agent, or Firm*—Stephen H. Eland; Dann, Dorfman, Herrell & Skillman

(57) ABSTRACT

A method and apparatus are provided for processing sets of sheets. The apparatus includes a frame, a hopper for moving a stack of sheets, a pre-singulator for separating a portion of a sheet from the stack, a sheet peeler for peeling part of a pre-singulated sheet from the stack, a sheet picker for gathering peeled sheets into a set, and a sheet discharger for clearing the set of sheets. The sheet peeler may include at least one rotating drum. The sheet picker may include one or more augers.

33 Claims, 11 Drawing Sheets

APPARATUS AND METHOD FOR PROCESSING SHEETS

PRIORITY CLAIM

This application claims priority to U.S. Provisional Patent Application No. 60/939,349, filed May 21, 2007, the entire disclosure of which is hereby incorporated by reference.

FIELD OF THE INVENTION

The present invention relates to an apparatus and method for processing sheets or documents. Specifically, the present invention relates to the feeding a series of documents from a stack of documents. In particular, the present invention relates to separating a stack of documents into sets of documents and discharging the sets from the stack.

BACKGROUND OF THE INVENTION

There are many applications in which it is necessary to feed documents from a stack of documents. One issue that commonly arises is double feeding, in which two documents are erroneously fed at the same time. Typically, it is desirable to feed only a single document. Accordingly, it is desirable to provide a feeder that efficiently feeds documents from a stack of documents without double feeding documents.

Additionally, sorting large stacks of sheets into organized sets of documents can be a time-consuming and tedious process. Many industries create large amounts of documents which need to be separated and organized into desired sets. For instance, insurance companies produce many documents containing policy information. Banks and brokerage firms routinely print client account statements and utility companies print monthly bills to be mailed to customers. Additionally, advertising companies print mass mailings for a large, targeted audience. These documents are often produced in large, unsorted stacks. Quick and efficient sorting is needed to maintain organized files.

When mailing high volumes of documents, it is relatively straight-forward to insert documents into envelopes for mailing. However, when multiple documents need to be inserted into each envelope, document processing becomes more difficult. Creating different sets of documents is often time-consuming, and once the sets are created, the documents must settle to allow the air between the documents to dissipate. These types of delays lead to a bottleneck in production and distribution. In other words, systems that are used to insert the sets of documents into envelopes can insert the documents faster than the sets of documents can be accumulated by a feeder.

Several techniques have developed in attempt to overcome the bottleneck. Some systems incorporate a multi-array system in which numerous machines are used to accumulate sets of documents so that the sets are can be conveyed to a single inserter system. Although such systems have improved through-put, the systems are expensive and bulky. Further, the known systems for feeding sets of documents use rollers to frictionally engage each document in the set. For some applications, the frictional force of the rollers against the documents may cause some damage to the documents.

Accordingly, an apparatus and method are desirable to quickly and accurately organize stacks of sheets into sets of documents.

SUMMARY OF THE INVENTION

In light of the foregoing, the present invention provides numerous improvements in the field of document processing. In one embodiment, an apparatus for processing documents is provided that comprises a feeder for feeding documents from a stack of documents. The feeder displaces a portion of the documents away from the stack of documents while a retainer retains a portion of the documents in the feeder. In this way, the feeder causes the first portion of the documents to curve away from the stack.

Additionally, the present invention provides an apparatus for processing a stack of sheets by sorting the stack into smaller sets of sheets. In one embodiment, the apparatus may include a hopper for transporting a stack of sheets for processing, a pre-singulator for separating a portion of several sheets positioned along the leading edge of the stack away from the stack. A sheet peeler may be provided to lift a portion of the leading sheet away from the stack and the sheets singulated by the pre-singulator. A sheet picker may be provided to lift the leading sheet away from the stack of sheets. A sheet discharger may be provided to eject sheets from the apparatus into an output bin.

Also provided is a method for sorting a stack of sheets into organized sets of documents. Specifically, a stack is conveyed along a hopper to a pre-singulator. Next, several sheets are partially lifted from the stack. The lifted sheets include several sheets along the leading side of the stack first engaging the pre-singulator. Once sheets are partially lifted, the leading sheet is lifted from the stack so that a portion of the leading sheet forms a bow-like shape. The leading sheet is removed from the stack and then discharged from the apparatus. This process may be repeated to accumulate desired sets of sheets.

In general, an apparatus and method are provided for separating sheets from a stack into a set of documents. In a particular aspect of the invention, an apparatus is provided for sorting a stack of sheets comprising a hopper, a pre-singulator, a sheet peeler, a sheet picker, and a sheet discharger.

The hopper moves a stack of sheets along a transporter from an input bin towards a sheet processor. Generally, a push plate, a pressure plate, and a pressure bar exert force against the stack of sheets and keep the stack of sheets together. Guide rails located on either side of the stack of sheets also hold the stack together. Multiple stack sensors control the speed at which the stack moves along the belt.

The pre-singulator lifts a portion of the foremost sheets along the leading face of the stack away from the stack. An air nozzle blows air onto the lower edge of the stack creating gaps between the sheets. The pre-singulated sheets are supported by a retaining bracket. Air blown on the stack pre-singulates the sheets. A retaining bracket pinches the pre-singulated sheets into a small bow. Accordingly, both air and the retaining bracket create a small bow.

The sheet peeler lifts a leading pre-singulated sheet into a larger bow. Specifically, a rotating drum having a vacuum port attracts a leading pre-singulated sheet. The rotating drum rotates, increasing the size of the bow in the lead sheet.

Once the sheet has been placed into a larger bow shape, a sheet picker moves the bowed sheet. The sheet picker comprises at least one auger having one or more auger fingers. An auger finger enters the gap created by the bow in the lead sheet and moves the sheet away from the sheet peeler. As the sheet is moved, the sheet is detected by a sheet sensor and/or scanned by a sheet reader. Once the sheet has been processed and moved away from the sheet peeler, subsequent bowed sheets are processed and collected by the auger finger into a set. Once a predetermined number of sheets are collected into a set, the sheets are ejected from the apparatus by a sheet discharger.

BRIEF DESCRIPTION OF THE DRAWINGS

The foregoing summary as well as the following description will be better understood when read in conjunction with the figures in which.

DETAILED DESCRIPTION OF THE INVENTION

Figure 1:
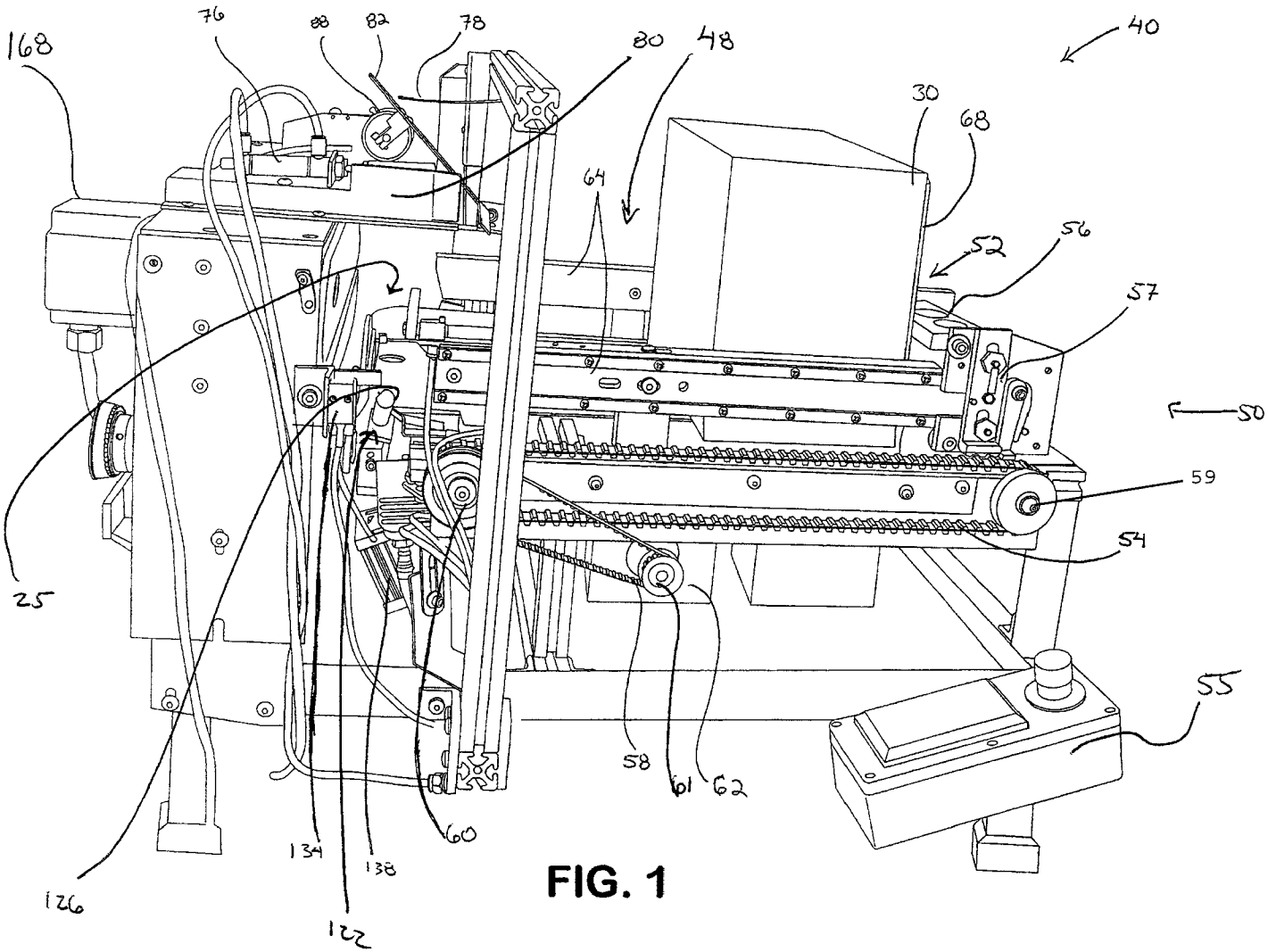
FIG. 1 is a front perspective view of a sheet processor in accordance with the present invention.

Referring now to the Figures in general, wherein like reference numerals refer to the same components across the several views, there is shown an apparatus 40 for sorting a stack 30 of sheets. In one embodiment, the apparatus 40 includes a hopper 50 for receiving the stack 30 of sheets. The hopper 50 feeds the stack 30 towards a sheet processor 25, which removes the sheets from the stack 30 in sets. A sheet discharger 160 ejects the sets of sheets toward an output bin. The sheet processor 25 performs several actions to separate the sheets from the stack 30 and form a set 20 of sheets. First, sheets are partially peeled from the stack 30. Then, each sheet is counted as it is partially removed. After the count reaches a predetermined number, the entire group, or set 20, is removed from the stack 30 and ejected toward the output bin.

The hopper 50 comprises a transporter 48 that moves the stack 30 of sheets towards the sheet processor 25. As the stack 30 moves toward the sheet processor 25, the stack is held together by a group of retainers. Multiple stack sensors 90, 91 are provided to sense the position of the stack 30 and control the speed of the transporter 48 as it moves the stack 30 of sheets towards the sheet processor 25.

Figure 4:
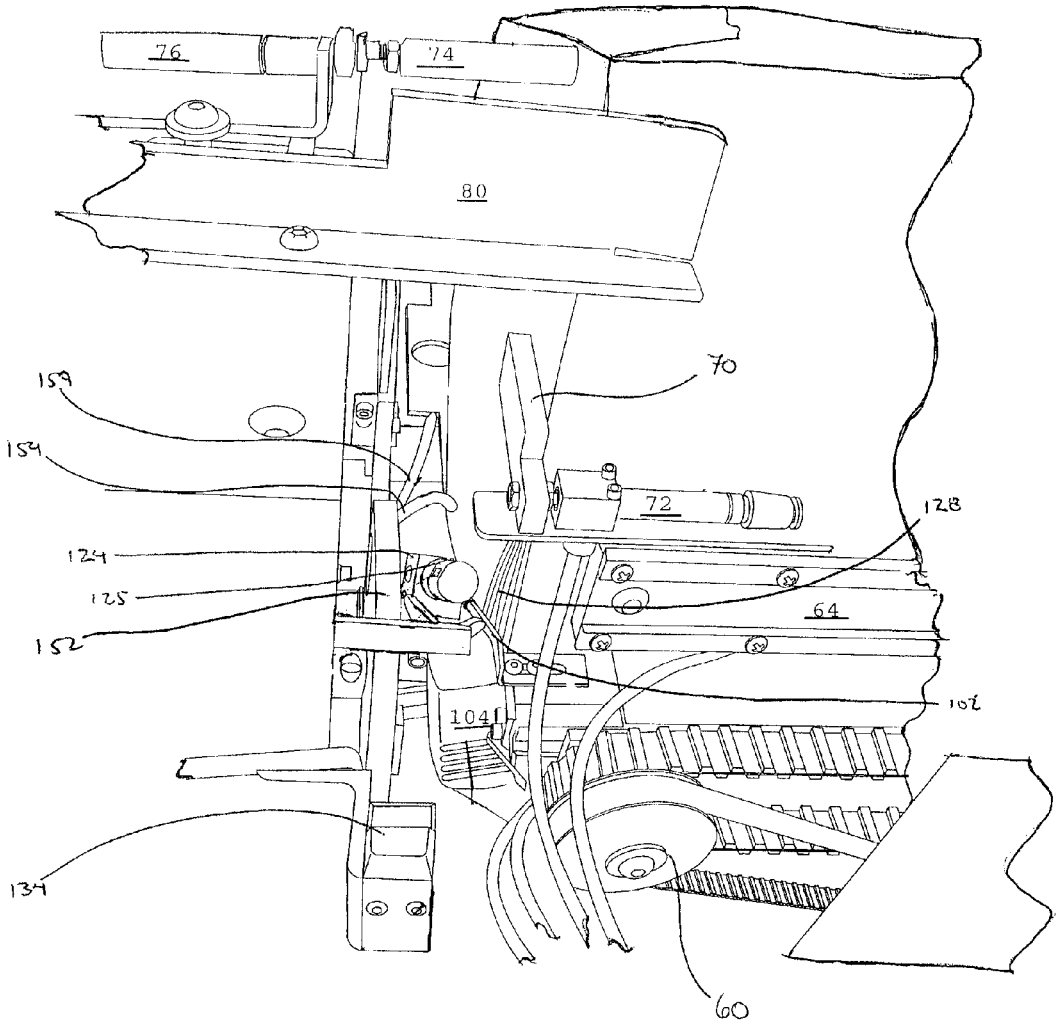
FIG. 4 is an enlarged perspective view of the sheet processor in FIG. 1, showing a sheet in a first bowed position.

From the hopper 50, the stack 30 is processed by the sheet processor 25. The sheet processor 25 comprises a sheet peeler 120 and a sheet picker 150. The sheet peeler 120 and sheet picker 150 separate a number of sheets from the stack 30, and gather the sheets into sets. A pre-singulator is provided to begin separating the sheets before the sheets enter the sheet peeler 120. The processor 25 may also include a pre-singulator 100. In the present instance, the pre-singulator 100 comprises an air nozzle 104 that blows air along the lower edge of the stack 30 in the hopper 50 to partially separate the sheets at the front of the stack. The pre-singulated sheets form a small bow shape identified in FIG. 4 as 128. This separation facilitates the ability to pull away a portion of each sheet to separate each sheet from the stack 30.

Figure 5:
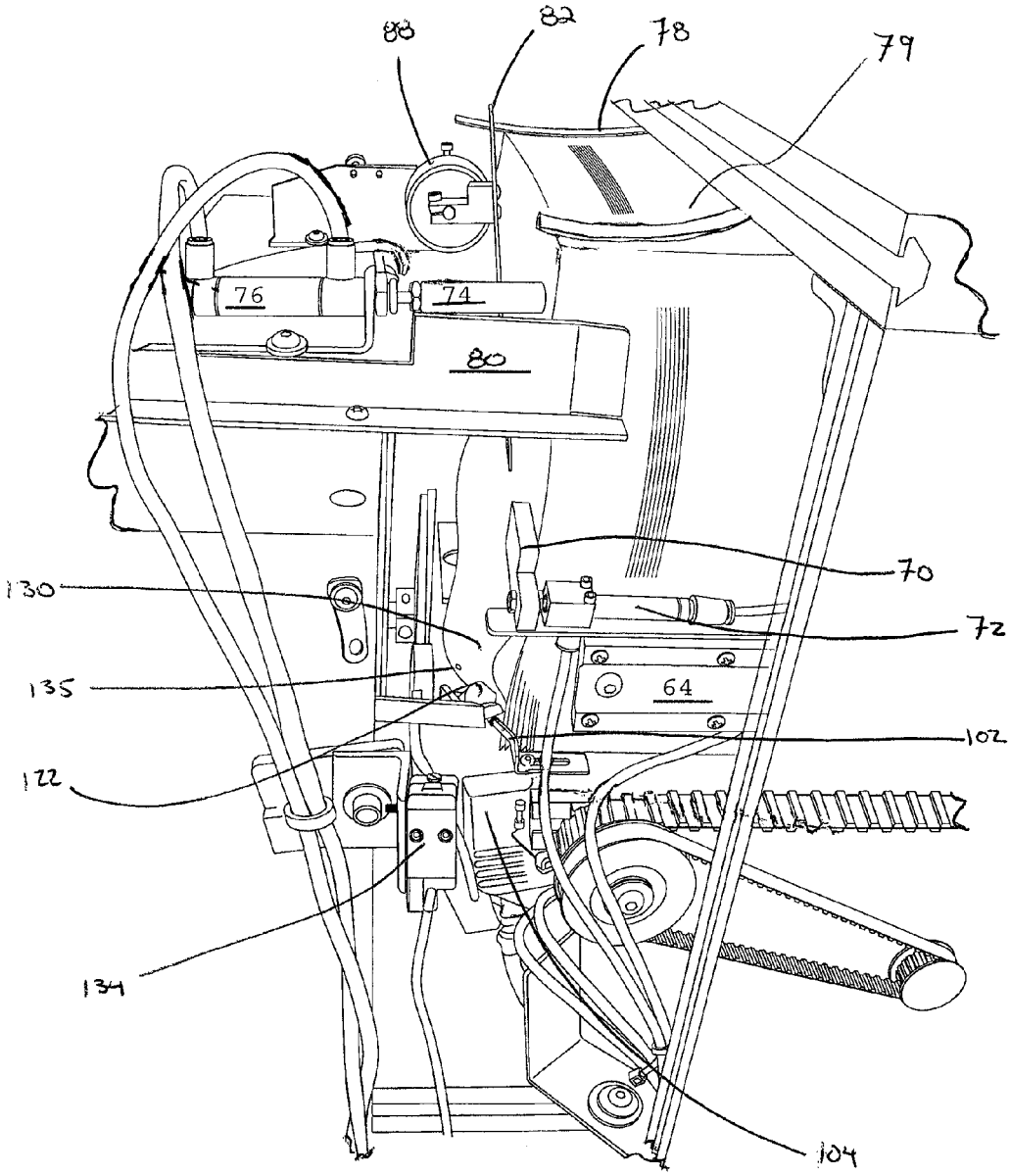
FIG. 5 is an enlarged perspective view of the sheet processor in FIG. 1 showing a sheet in a second bowed position.

The sheet peeler 120 pulls away or peels the pre-singulated sheets from the stack 30. The sheet peeler 120 comprises a rotary drum 122 having a vacuum port 126 and a rotating drum head 125. The vacuum port 126 attracts the leading sheet to the drum head 125. The drum head 125 rotates, thereby pulling the sheet away from the stack, causing the bow to become enlarged. In FIG. 5 the enlarged bow is identified as 130. The large bow 130 forms a gap between the leading sheet and the rest of the stack 30. The sheet picker 150 moves into the gap to separate a portion of the bowed sheet from the stack 30.

The sheet picker 150 comprises an element configured to separate the sheet further from the stack after the sheet peeler pulls a portion of the sheet from the stack. In the present instance, the sheet picker comprises at least one rotating auger 152 having at least one auger finger 154. As the auger 152 rotates, the first auger finger 154 moves through the gap created by the bow 130. As the first auger finger 154 moves through the bow 130, the finger 154 separates the lower portion of the sheet from the stack 30 and moves the lower portion of the sheet onto an auger shaft which forms a ledge 153 spaced apart from the stack. While the auger separates a portion of the sheet from the stack, one or more retainer elements retain the rest of the sheet up against the stack of sheets.

The sheets that are resting on the ledge 153 form a set. As each sheet is peeled from the stack 30, one or more counters count the sheets. Once the counters determine that the proper number of sheets have been separated onto the ledge 153, a set discharger 160 ejects the set 20 from the sheet processor 25.

Hopper

Figure 2:
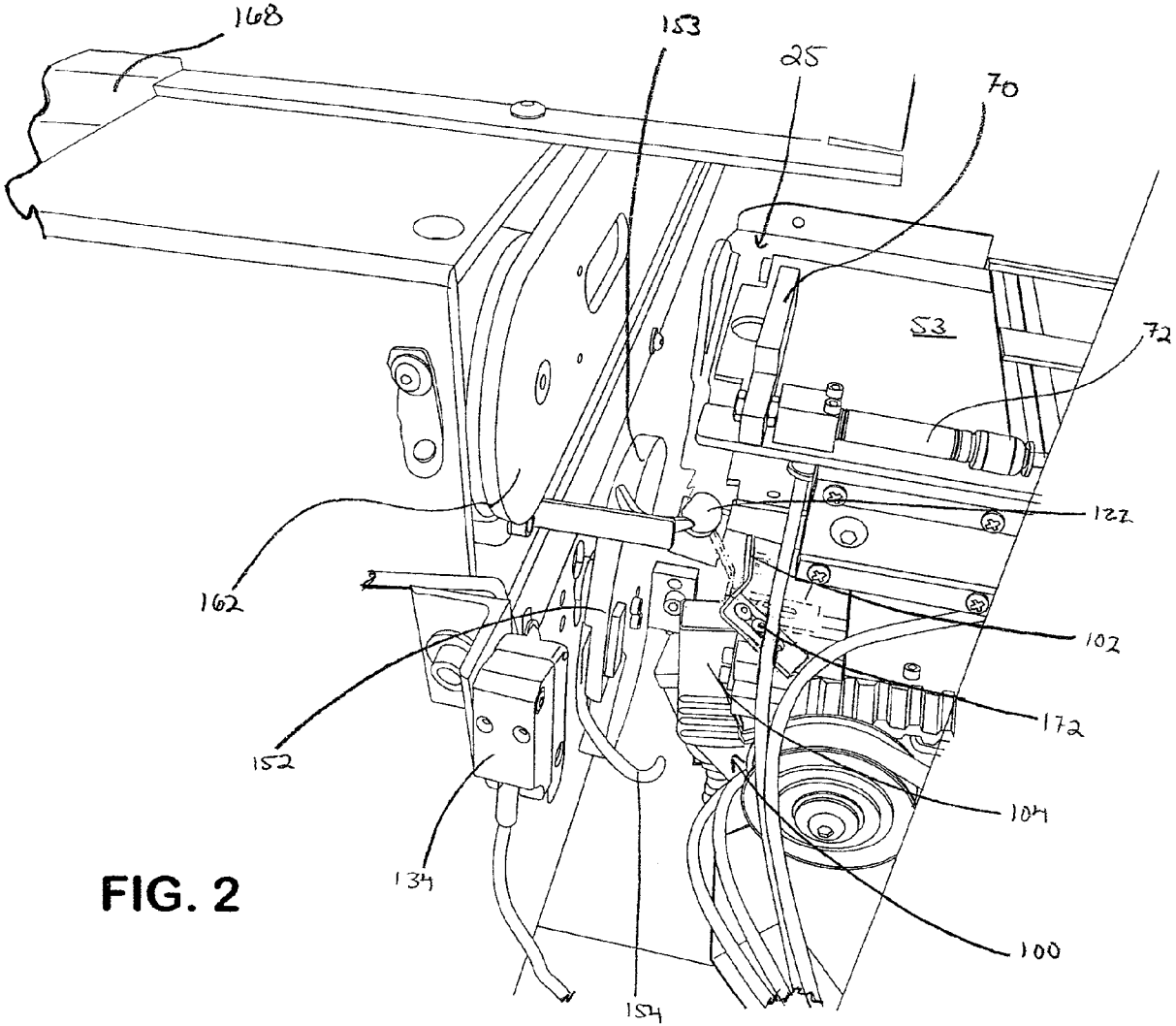
FIG. 2 is a fragmentary enlarged perspective view of a pre-singulator, a sheet picker, and a sheet peeler of the apparatus in FIG. 1.

Turning now to FIGS. 1-2, the apparatus 40 will be described in greater detail. To begin processing sheets, a stack of sheets 30 is placed into the hopper 50. The hopper 50 comprises a transporter 48 for moving the stack 30, multiple retainers for keeping the stack together, and one or more stack sensors 90, 91 for monitoring the position of the stack.

FIG. 1 shows the belts which drive the stack 30 of sheets along the hopper 50. A drive belt 58 is positioned below the stack 30 of sheets and angled away from the stack. The drive belt 58 connects a motor 62 to a head pulley 60 via a motor pulley 61. The head pulley 60 is located towards the forward end of the hopper 50 (i.e. the left end of the hopper from the perspective of FIG. 1). The drive belt 58 drives the head pulley 60 which in turn drives a toothed belt 54.

The toothed belt 54 spans substantially the length of the hopper 50 and is entrained around a second pulley 59 adjacent to the tail end of the hopper (i.e. the right end of the hopper from the perspective of FIG. 1). A vertical post 57 is positioned towards the tail end of the stack 30 of sheets and interacts with the toothed belt 54. Specifically, a moveable dog on the vertical post releasably engages the toothed belt 54.

When the dog engages the belt 54, movement of the belt 54 drives the vertical post 57 forwardly. Specifically, in the present instance, the dog is a vertically displaceable element sized to fit in the recess between adjacent teeth on the toothed belt 54. The dog is vertically displaceable between two positions: an upper or retracted position, and a lower or engaged position. In the retracted position, the dog is positioned above the belt so that the dog is disengaged from the toothed belt 54. In the engaged position, the dog is lowered so that it is positioned in the space between adjacent teeth. In the retracted position, the vertical post 57 is free to be displaced relative to the toothed belt 54. In the engaged position, the vertical post 57 is constrained so that when the belt moves, the vertical post moves, and when the belt stops, the vertical post stops.

The vertical post 57 is connected with the driver 52, such that when the toothed belt 54 drives the vertical post, it also displaces the driver. The driver 52 supports the rearward end of the stack 30, so that forward movement of the driver moves the stack forwardly. The driver 52 includes a horizontal bar 56 and a push plate 68. The horizontal bar 56 extends from the vertical post 57 and supports the push plate 68. The push plate 68 is a planar surface positioned generally parallel to the rearward face of the stack 30. Together, the horizontal bar 56 and the push plate 68 urge the stack 30 towards the sheet processor 25.

The stack 30 is supported by several retainers. Retainers support the stack 30 at various pressure points and maintain the integrity of the stack. The retainers supporting the lead face of the stack will now be described from the perspective of FIG. 5. For purposes of orientation, in this paragraph, "front" refers to the face of the leading sheet and "left" refers to the side of the leading sheet towards the backside of the apparatus 40. The right and left edges of the sheet are supported by a pair of guide rails 64, one of which can be seen in FIG. 5. A top restraint 78 is positioned above the stack and urges downwardly on the top edge of the stack. A second top restraint 79 may also be provided. As shown in FIG. 2, the bottom edge of the stack is supported by the base plate 53. Returning to FIG. 5, the top right portion of the face of the lead sheet is supported by a pressure bar 74. The top left portion of the face of the lead sheet is supported by a bias bar 82. The mid- to lower-portion of the right side of the face of the lead sheet is supported by a pressure plate 70. Each of these retainers is described in greater detail below.

The retainers 64, 70, 72, 74, 78, 79, 82, operate to maintain the integrity of the stack 30 to prevent the sheets from folding over, falling out of the stack or otherwise becoming dislodged. Although the retainers 64, 70, 72, 74, 78, 79, 82, may be positioned in a variety of locations, in the present instance, the retainers are positioned at locations designed to encourage a desired amount of bowing of the sheets during processing.

As mentioned above, one of the retainers is the pressure bar 74. The pressure bar 74 is configured to contact the top portion of the leading edge of the stack 30. The pressure bar 74 is a cylindrical bar positioned transverse to the leading edge of the stack 30 so that the bar engages the front face of the leading sheet in the stack. The position of the pressure bar 74 is controlled by a plunger 76. The plunger 76 connects to a series of tubes which force pressurized air through the plunger into the pressure bar 74 to support the stack 30. The pressure bar 74 engages the stack 30 and supports the upper right portion of the face of the leading sheet. Although the pressure bar 74 supports the leading sheet, the pressure bar does not impede movement of the stack 30 towards the sheet processor 25. Also, the pressure bar 74 engages the stack as the stack enters the sheet processor 25. As discussed below, the pressure bar 74 may retract from the stack 30 when a set 20 clears the apparatus 40.

Another retainer supporting the face of the stack 30 is the pressure plate 70. The pressure plate 70 is a rectangularly shaped plate that rests against the mid- to lower-portion of the stack 30 along the right side of the leading sheet. See, for example, FIG. 4, wherein the pressure plate 70 is shown in contact with the lead sheet. The pressure plate 70 exerts force against the stack 30 to hold the sheets together. The pressure plate 70 is controlled by an air cylinder 72. The air cylinder 72 is located above the front guide rail 64. The air cylinder 72 regulates air pressure to control the position of the pressure plate 70. The pressure plate 70 engages the stack 30 as the stack is advanced toward the sheet processor 25. Movement of the pressure plate 70 will be discussed further below.

Turning to FIGS. 5, 7, 9, and 10, the leading face of the stack is also supported by a bias bar 82. The bias bar 82 is an "L" shaped bar which is biased toward the stack 30 and which is positioned towards the backside of the apparatus. A biasing element such as a spring biases the bias bar toward the stack of sheets. As the driver 52 displaces the stack 30 toward the sheet processor 25 against the bias of the bias bar 82, the stack pushes against the bias bar and the bias bar moves into a generally upright position. Additionally, a solenoid 88 connected with the bias bar drives the bias bar rearwardly away from the stack 30. The solenoid 88 is energized during the process of discharging sets from the sheet feeder as discussed further below.

A pair of guide rails 64 supports the sides of the stack 30. The guide rails 64 are a pair of generally rectangular elongated rails that extend along the length of the hopper 50 to support the sides of the stack 30, as shown in FIG. 1. One or more top restraints are provided 78, 79. The top restraints 78, 79 are thin, rectangular bars which extend from a top portion of a frame. The top restraints 78, 79 are located near the sheet processor 25 and exert force along the top edge of the stack 30 to hold the sheets together. Specifically, the top restraints 78, 79 exert force downwardly onto the stack 30 along the top edge of the sheets.

The hopper 50 maintains the stack at a slight incline to impede sheets from falling forward from the stack. Specifically, the end of the hopper 50 near the sheet processor 25 is slightly elevated from the opposite end of the hopper (i.e. the right end of the hopper from the perspective of FIG. 1). Accordingly, as the stack is driven along the hopper 50, the stack is oriented at a slight backward-leaning angle.

Figure 9:
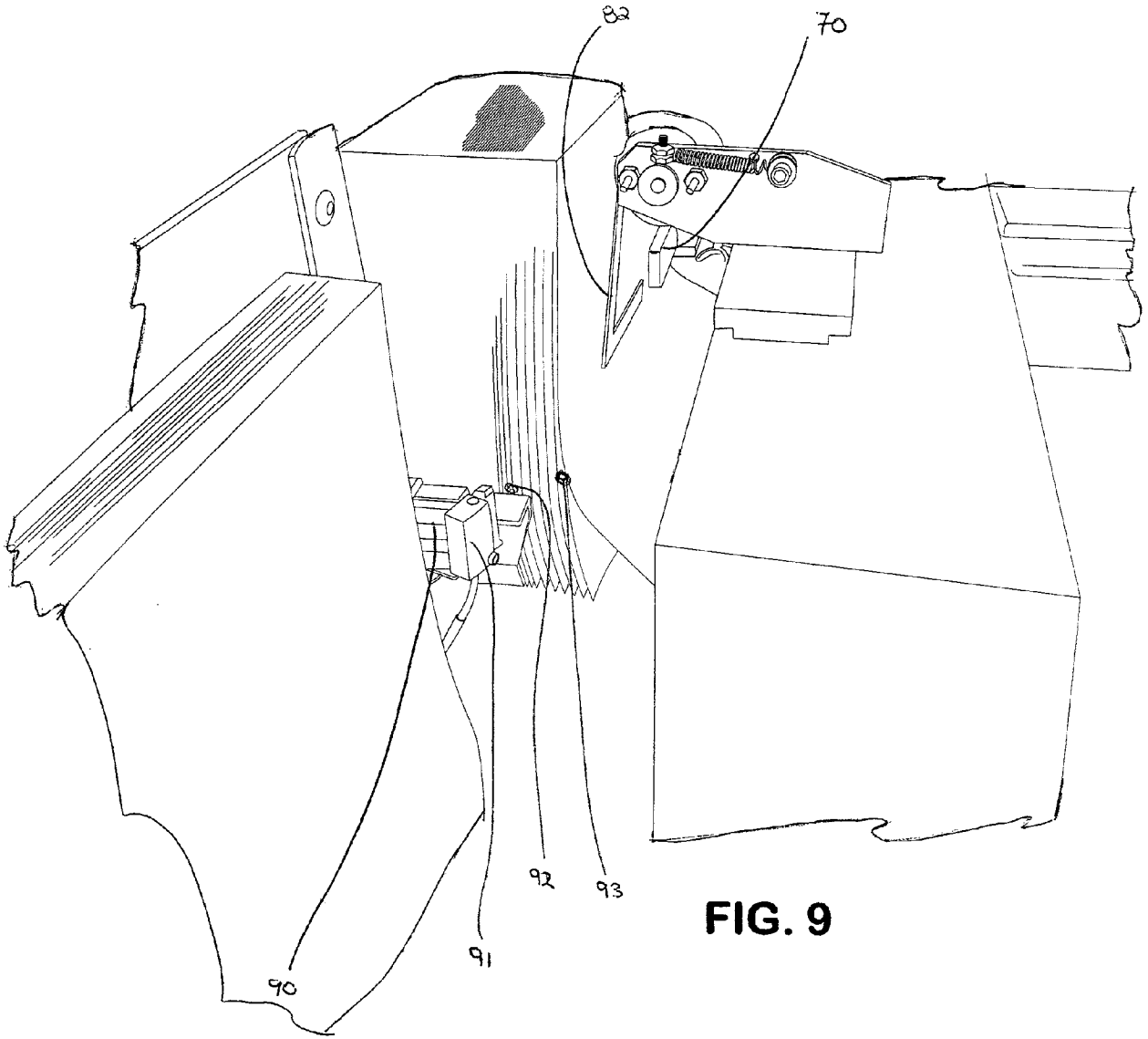
FIG. 9 is a rear enlarged view of the stack sensor.

Turning to FIG. 9, two stack sensors 90, 91 are provided in the hopper 50 to detect the position of the stack 30. The stack sensors 90, 91 are located towards the backside of the apparatus 40. The stack sensors 90, 91 project laser beams 92, 93 onto the back side of the stack 30 of sheets. The first stack sensor 90 shines on the side of the stack 30 near the guide rail 64 and the second stack sensor 91 shines on the side of the stack near the leading sheet. If no sheets are detected by the laser sensors 90, 91, the motor 62 rapidly advances the stack 30 until the first stack sensor 90 detects a beam. When the first stack sensor 90 detects a beam, the motor 62 slows the speed of the stack along the transporter 48. When the second stack sensor 91 detects a beam, the motor 62 stops the transporter 48, which stops displacement of the stack 30.

Pre-Singulator

Once the stack 30 has been transported from the hopper 50, the sheets are processed by a pre-singulator 100. The pre-singulator 100 directs air toward the leading edge of the stack 30 to create gaps between the sheets at the front end of the stack. In doing so, the pre-singulator 100 begins the process of separating the lower edge of the sheets from the stack 30.

The pre-singulator 100 comprises a retaining bracket 102 and an air nozzle 104. Retainers 70, 74 continue to support the stack 30 of sheets. Specifically, the pressure plate 70 and the pressure bar 74 maintain force against the leading face of the stack 30 to impede the sheets from being pulled off the stack while the sheets are pre-singulated.

Turning now to FIGS. 4-6 and 11, the pre-singulator 100 will be described in greater detail. The air nozzle 104 of the pre-singulator is located below the stack 30 generally transverse the length of the stack. The air nozzle 104 is spaced apart from the forward or leading edge of the base plate 53 of the hopper 50. The positioning of the air nozzle 104 affects where air is blown onto the stack 30. In the present instance, the air nozzle 104 is positioned below the level of the bottom edge of the stack 30 and is oriented to direct a stream of air generally upwardly and toward the backside of the stack. In this way, the air nozzle 104 directs a flow of air toward the middle part of the lower edge of the leading side of the stack 30.

Air is blown from the nozzle 104 onto the stack 30 through a first port 110 and a second port 112. The second port 112 connects to a transformer positioned below the air nozzle 104. The transformer ionizes air blown from the second port 112. Often, static between the sheets in the stack creates static cling that can create difficulty separating the sheets, which impedes pre-singulation. Accordingly, ionized air reduces the static on the sheets to improve the singulation process.

Optionally, a second air nozzle may be provided. Often when sheets are placed into a stack, the sheets may adhere to one another due to static, humidity, or other such conditions. Accordingly, a second nozzle may be desirable to separate the joined sheets and to prepare the sheets for pre-singulation.

The second air nozzle may be positioned next to the first air nozzle 104. For example, in FIG. 1, the second air nozzle may be located next to the first air nozzle and spaced towards the right side of the apparatus 40. The second air nozzle blows high pressure air toward the lower edge of the stack. The force of the high pressure air overcomes the effects of static and/or humidity that tend to adhere the sheets in the stack, thereby facilitating proper pre-singulation by the first air nozzle 104. The air pressure from the second nozzle may be too great to properly control the formation of the bow during pre-singulation. Therefore the second nozzle is positioned so that the force of the air from the second nozzle does not impinge on the lead sheet in the stack.

As noted above, the position of the air nozzle 104 affects how the air flows onto the stack 30. The air nozzle 104 blows air onto the stack 30 to pre-singulate a portion of the sheets at the leading end of the stack while the sheets are still attached to the stack. In a preferred embodiment, air is blown from the nozzle 104 onto the stack 30 at a slight offset from the corner towards the center of the stack. The air causes the sheets at the corner of the stack 30 to pre-singulate. The pre-singulation of the sheet separates a portion of the sheets near the bottom edge of the stack 30, while the upper portion of the sheets is still retained with the stack. In a preferred embodiment, approximately 100 to 200 sheets located towards the leading face of the stack 30 may be pre-singulated. The amount of the stack which is pre-singulated by the air nozzle 104 can vary based upon how much air is blown upon the stack 30, as will be discussed in further detail below. As the sheets are partially separated during pre-singulation, the sheets are actually urged apart, creating gaps between each other and the stack 30. As the sheets pre-singulate, the bottom edge of the stack 30 is actually enlarged when compared to a stack which is not pre-singulated. The amount of space between each pre-singulated sheet decreases from the foremost, or leading, pre-singulated sheet towards the center of the stack. Specifically, the space created between the first and second pre-singulated sheets is larger than the space created between the second and third pre-singulated sheets.

As the volume of air blown along the lower edge of the stack 30 increases, so does the number of sheets pre-singulated from the stack 30. As the number of pre-singulated sheets increases, the positioning of the stack sensors 90, 91 may be adjusted for correct detection of the stack.

A retaining bracket 102 is positioned above the air nozzle 104 and beyond the end of the base plate 53. The retaining bracket 102 is a rectangular arm which extends in front of the leading face of the stack 30. The retaining bracket 102 holds back the corner of the pre-singulated sheets and keeps the sheets near the stack 30. In this way, as the stream of air from the air nozzle 104 urges the sheets away from the stack, the retaining bracket holds back a corner of the sheets, thereby creating a small bow 128 in the sheets. The bow may form a variety of shapes in response to the stream of air. However, in the present instance, the retainers and the retaining bracket 102 are positioned to interact with the sheets such that the air stream blows the sheets away from the stack and toward the sheet peeled. Specifically, the retainers and the retaining bracket 102 engage the sheets, such that the curve of the bow has a peak adjacent to the sheet picker, and the bow curves from the peak toward the retaining bracket without reversing directions.

In a preferred embodiment, the base plate 53 can have at least one notched corner through which air from the pre-singulator 100 blows onto the stack 30. For instance, in FIG. 1, the notch may be located towards the front of the apparatus in the portion of the base plate 53 near the rotary drum 122. Air blows from the pre-singulator 100 through the notch in the base plate 53 directly onto the sheets.

In a preferred embodiment, the bow which forms generally overlaps the base plate 53. The sheets are pre-singulated by the air nozzle 104. As the sheets are pre-singulated, gaps form between the sheets causing the bottom portion of the stack to expand. Generally, the pre-singulated sheets expand in the region of the base plate 53. In the preferred embodiment the air nozzle 104 blows through the notch in the base plate 53 towards the center of the stack. Specifically, in FIG. 1, the lower corner of the stack towards the front of the apparatus 40 expands toward the sheet peeler 120.

As the stack expands, the lead sheet forms a bow. The curve of the bow has an apex spaced apart from the stack. In the present instance the bow is formed so that the apex is positioned near a line formed by the leading edge of the base plate.

Further, the lower corner of the stack towards the back side of the apparatus 40 is held together to prevent the back side of the stack from bowing or expanding. Accordingly, the front portion of the sheets which are pre-singulated are positioned above the notch in the base plate 53. The bow formed during pre-singulation extends toward the sheet peeler 120. The cushion created by air between the stack and the base plate 53 supports the newly formed bow so that the bow can be wider and more easily controlled While it may be desirable to form the bow over the base plate 53, the bow may form without the base plate 53. If no base plate is present, guide rails 64 support and suspend the stack, and bottom rails may be provided to support the bottom of the stack.

Sheet Peeler

Once the sheets have been pre-singulated, the sheet peeler 120 peels a portion of a pre-singulated sheet away from the stack 30. Specifically, the sheet peeler 120 engages the small bow 128 in the leading sheet of the stack 30. The sheet peeler 120 pulls the lead sheet at the pre-singulator to enlarge the bow 128 into a larger bow 130 as shown in FIG. 5 to prepare for the process of separating the entire lower portion of the sheet from the stack.

The sheet peeler 120 comprises a rotary drum 122 and, as noted above, the retainers continue to maintain the stack 30 as a unit while the sheet peeler pulls away the pre-singulated sheets. The rotary drum 122 is positioned below the base plate 53 and transverse to the stack of sheets. The rotary drum 122 has a cylindrical drum head 125 which rests upon a manifold 124. The drum head 125 has at least one port 126 which is disposed along the side of the drum head 125. The port 126 is capable of acting as a vacuum port 126. Alternatively, the port 126 is capable of acting as an air orifice. The cylindrical drum head 125 rotates in a counterclockwise fashion around an axis. The rotary drum 122 acts on the sheets to enlarge the bow in the sheets, by moving the sheets from a first position in which a portion of the sheet is shaped like a small bow 128, to a second position in which the sheet is shaped into a large bow 130.

Figure 6:
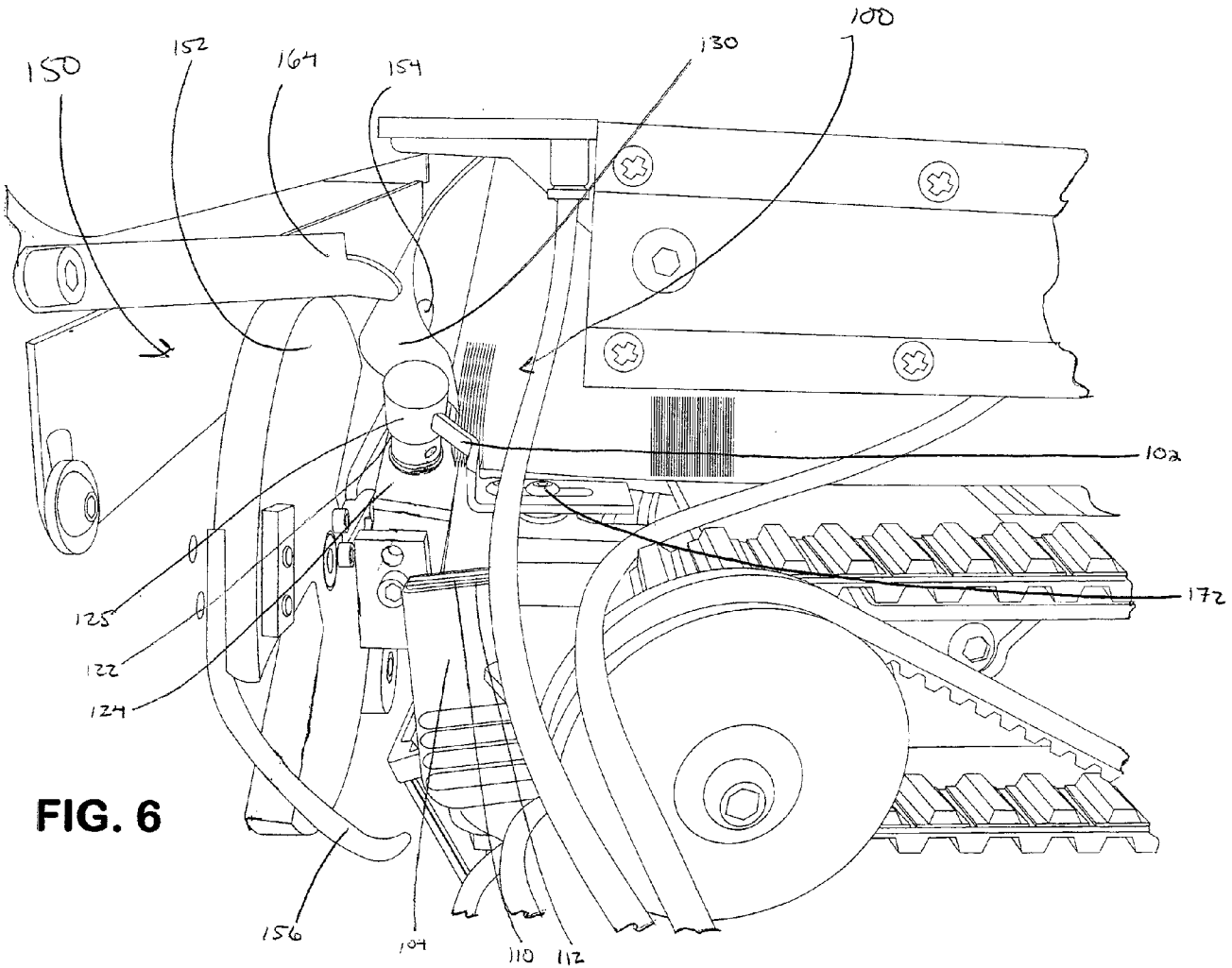
FIG. 6 is an enlarged perspective view of the sheet peeler, the sheet picker, and a peeled sheet.

During operation, the rotary drum 122 peels a portion of a sheet from the stack 30. Specifically, the pre-singulated portion of a sheet shaped like a small bow 128 is peeled from the stack by the rotary drum 122. As shown in FIGS. 5 and 6, in a preferred embodiment, the rotary drum 122 engages a portion of the leading pre-singulated sheet near the front side corner (i.e. the lower right-hand corner of the sheet from the perspective of FIG. 6). Preferably, the corner of the leading sheet is still held back by the retaining bracket 102. Optionally, multiple rotary drums 122 may be present.

Activation of the rotary drum 122 peels a portion of pre-singulated sheets from the stack 30. In a first position, the drum head 125 is rotated so that a vacuum port 126 on the drum head 125 is directed generally towards the small bow 128 of the pre-singulated sheets. A vacuum valve controls the vacuum flow to the vacuum port 126 in the rotary drum 122, so that when the vacuum port 126 is directed toward the stack 30, vacuum is applied to the vacuum port, creating a suction force in the gap between the drum head 125 and the stack of sheets. The suction draws the leading pre-singulated sheet toward the vacuum port 126 on the drum head 125. The small bow portion 128 of the leading pre-singulated sheet contacts the drum head 125 and then the drum head rotates counterclockwise away from the stack 30. As the drum head 125 and the pre-singulated sheet move away from the stack, the sheet forms a larger bow-like shape 130, as shown in FIG. 6.

The angle of the drum head 125 relative to the stack 30 of sheets affects the peeling of sheets from the stack. Specifically, the location of the rotary drum 122 and the angle of the drum head 125 change the size of the bow in the sheet after the rotary drum peels away the sheet. Generally, the drum head 125 is positioned near the bottom edge of the stack 30. In a preferred embodiment, the drum head 125 interacts with a portion of the leading sheet near, but not directly at, the corner. The rotary drum 122 contacts sheets which have already been pre-singulated and shaped into a small bow 128. It is desirable that the drum head 125 only peels away one sheet at the time. Sheets may not be properly singulated if the bow is too small or too large. Further, a reverse bow may form when a sheet bows towards the stack. The reverse bow impedes proper processing of the sheets. To reduce the likelihood of forming a reverse bow, the drum head 125 is positioned so that the drum head does not directly interact with the corner of the leading sheet. If the sheet peeler 120 interacts with the back face of the sheet, the sheet could bow towards the stack. In the preferred embodiment, the drum head 125 is positioned along an axis providing for the largest possible bow but with a lessened risk of the sheet flipping from the drum head. An example of the preferred embodiment is depicted in FIG. 6. It should be noted that while the Figures depict singulation of the lower righthand corner of the leading sheet, the stack of sheets can be oriented so that any corner of the stack can be singulated.

As noted above in regard to the hopper 50, the retaining bracket 102 holds back pre-singulated sheets. By holding back the pre-singulated sheets, the retaining bracket 102 impedes subsequent pre-singulated sheets from engaging the rotary drum 122. Specifically, the retaining bracket 102 singulates sheets for processing by the sheet peeler 120 by maintaining a gap between the rotary drum 122 and the stack 30.

The positioning of the retaining bracket 102 affects how the sheets are peeled from the stack 30. The retaining bracket 102 retains the corner of the sheets. If the retaining bracket 102 is positioned too far away or too low on the stack 30, the sheets may flip over the retaining bracket 102 and the sheets would not be singulated. On the other hand, if the retaining bracket 102 is positioned vertically too high along the stack 30, the sheets could create a reverse bow formation.

As noted above, retainers support the stack 30 at various pressure points. As the stack is held together by the retainers, pressure points support the stack as air pre-singulates a portion of the stack. Accordingly, the pressure points pre-singulate the sheets. If the pressure points are altered, sheets may not pre-singulate. However, it may be desirable to change the pressure points. By changing the pressure points, the apparatus may accommodate sheets having different orientations or configurations. For instance, sheets within the stack may be curved as a result of printing. The curvature of the sheets might impede processing by the sheet processor. By adjusting pressure points on the stack, the curved sheets may be pre-singulated, peeled, and picked from the stack as described above. Accordingly, the retainers that support the sheets may be adjusted based on the configuration of the sheets to be processed.

Further, the sheets may not properly form a small bow shape 128. If the bow is not properly shaped, the sheet peeler 120 may pick up the first two sheets instead of just the leading sheet. If the rotary drum 122 engages two sheets, the sheets will not properly adhere to the vacuum port 126. The bow created by the rotary drum 122 will be smaller than if one sheet contacted the rotary drum 122. Further, the smaller bow may not be properly positioned for the sheet picker 160. However, as discussed further below, the peeler and picker are oriented and configured such that the picker does not separate the sheets in the event that the peeler entrains two sheets at a time. Instead, as the rotary drum 122 continues to rotate, the sheets will disengage the vacuum port 126. Specifically, as the drum rotates, the angle of the vacuum port relative to the entrained sheets changes and the suction of the vacuum is not sufficient to retain the sheets against the drum. As the rotary drum 122 rotates back around, the vacuum port 126 again is positioned adjacent the pre-singulator. If the peeler again entrains two sheets, the rotary drum will again rotate around until the sheets disengage the peeler. The process will continue until the rotary head entrains a single sheet. Additionally, the system monitors the number of times the drum rotates without peeling a sheet to a position that the picker is able to engage the sheet from the drum. If the number exceeds a pre-determined threshold, the retainer bracket 102 is manipulated to agitate the stack in an attempt to separate the sheets that are stuck together. Specifically, the retainer bracket 102 reciprocally pivots about a pivot point to contact and agitate the stack, thereby causing the joined sheets to separate from one another. After agitating the stack 30, the retaining bracket 102 displaces away from the stack so that the leading edge of the retaining bracket is pivoted away from the pinched position. FIG. 2 also shows the retaining bracket 102 in phantom lines, pivoted away from the pinched position. In FIG. 2, the retaining bracket 102 is illustrated in solid lines in the pinched position.

Sheet Picker

After sheets have been peeled off the stack by the rotary drum 122, the sheets are picked off the rotary drum by a sheet picker 150. As mentioned previously, retainers hold the stack 30 of sheets together while the picker 150 pulls the lower edge of the sheets away from the stack.

Figure 8:
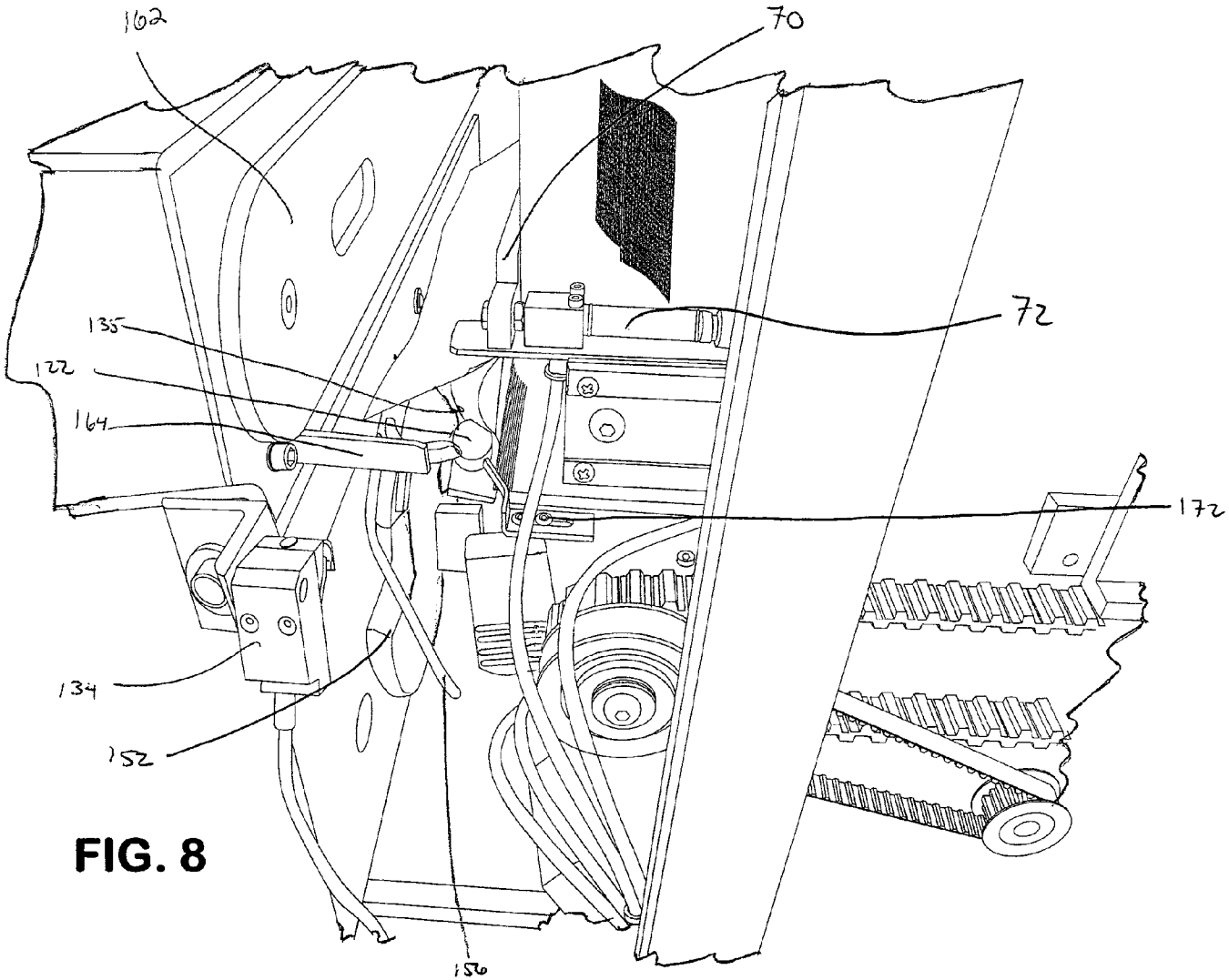
FIG. 8 is an enlarged perspective view of the sheet peeler, sheet picker, and the sheet sensor detecting a peeled sheet.

Turning to FIG. 6, the sheet picker comprises an auger 152 located generally transverse to the stack of sheets. The auger 152 comprises one or more auger fingers, 154, 156. The auger fingers 154, 156 are connected at one end to the auger 152. The far end of each auger fingers 154, 156 is bent. The bend of the auger fingers 154, 156 corresponds to the shape created by the bow in the sheet entrain by the peeler 120. The auger 152 rotates, causing the first auger finger 154 to move from the rear of the apparatus 40 towards the front of the apparatus. FIG. 6. The first auger finger 154 enters the gap in the large bow 130 of the sheet. As the first auger finger 154 moves through the gap, the sheet is picked from the rotary drum 122 and placed onto an auger shaft which forms a ledge 153 as depicted in FIG. 8. The first auger finger 154 opens the corner of the sheet so that the sheet reader 138 can detect information on the lower edge of the sheet near the corner portion. Preferably, approximately one quarter to one third of the corner region along the lower edge of the sheet is opened. This opened portion is placed on the ledge 153. While the lower, lifted portion rests on the ledge 153, the upper portion of the sheet remains part of the stack 30.

In a preferred embodiment, the auger 152 comprises two auger fingers. 154, 156. The first auger finger 154 enters the bow of a first peeled sheet while the second auger finger 156 rotates away from the peeled sheet. Once the first auger finger 154 has moved through the first peeled sheet, the second auger finger 156 rotates up through the bow of a second peeled sheet. As the second finger 156 rotates through the bow of the second sheet, the first auger finger 154 rotates down away from the second sheet. Much like the first auger finger 154, the second auger finger 156 separates the corner portion of the second sheet from the rotary drum 122.

Since both the rotary drum 122 and the auger finger 154 are both moving, it is desirable to coordinate the interaction between the rotary drum 122 of the peeler and the auger finger 154. The efficiency of the auger 152 may be increased by providing two auger fingers 154, 156 as described above. Specifically, the rotating drum 122 rotates once for each sheet that is peeled. Similarly, an auger finger passes by the peeler each time the finger pulls away a sheet. If the auger has a single finger, the auger rotates once each time the peeler rotates once. If the auger includes two auger fingers, the auger can be turned at a speed such that it rotates once for every two rotations of the rotary drum.

The rotating drum 122 constantly rotates while processing a set of sheets. For instance, the rotating drum 122 rotates counterclockwise towards the stack of pre-singulated sheets and contacts the first pre-singulated, small bowed sheet 128. The drum head 125 and the sheet continue moving counterclockwise and the sheet forms a large bow 130. The auger then removes the sheet from the rotary drum 122 and the drum continues to rotate back around towards the stack to grab a subsequent pre-singulated sheet.

Likewise, the auger 152 continually rotates. Specifically, the auger 152 rotates so that a first auger finger 154 moves up through the large bow 130 in the sheet on the peeler 120, slides through the large bow, and then moves the sheet onto an auger shaft which forms a ledge 153. As the sheet slides onto the ledge 153, the first auger finger 154 moves downward away from the rotary drum 122 and completes a full rotation. Then the auger finger 154 comes back up and is positioned to process a subsequent sheet.

Optionally, a second auger 158 can be used. The second auger 158 lags after the first auger 152 in processing sheets. The second auger 158 has at least one finger 159. In a preferred embodiment, the second auger 158 also comprises two auger fingers. When a second auger 158 is present, the auger fingers completely pull away from the stack approximately a quarter to a third of the lower portion of the sheets. Preferably, the two augers are positioned to rotate in opposite directions so that a sheet can be opened from the middle of the lower edge towards the outer portion of the lower edge. In other words, the first auger opens a gap between the lower right hand portion of a sheet and the rest of the stack. The peeler aids in the process of opening the gap. After the first auger begins to open the gap, the second auger rotates into the gap and opens a gap between the lower left hand portion of the sheet and the rest of the stack. The first auger separates the right hand portion of the sheet by rotating from the middle of the sheet toward the front side of the system. The second auger separates the left hand side by rotating from the middle of the sheet toward the back side of the system. The second auger is timed so that it lags behind the first auger, so that the first auger opens the gap between the first two sheets at the pre-singulator and then the second auger opens the gap.

By using two augers to separate the bottom portion of the sheets from the stack, the sheet picker is able to create a gap along the entire bottom edge of the sheets. In this way, when a sheet is picked, a larger portion of the bottom edge of the subsequent document is revealed. By revealing a larger portion of the subsequent document, the system is able to scan a greater portion of the subsequent document, as discussed further below.

Several sensors 134, 138 are present to detect information on the sheets. A sheet sensor 134 counts the number of sheets processed by the rotary drum 122 that are to be collected into a set 20. The sheet sensor 134 detects the presence of a picked sheet to count the number of sheets in a set 20. Turning to FIG. 5, the sheet sensor 134 is positioned below the stack adjacent the air nozzle 104. The sheet sensor 134 shines a laser beam 135 from the front of the apparatus 40 towards the rear of the apparatus. A reflector is positioned below and toward the back side of the apparatus. In FIG. 5, the laser beam 135 shines onto the peeled sheet. When the rotary drum 122 is not in contact with a sheet, the sheet sensor 134 shines the laser beam 135 towards the rear of the apparatus 40 and hits a reflector. The reflector shines the laser beam 135 back towards the sheet sensor 134 and the sheet sensor detects the reflected beam. When the sheet is entrained on the rotary drum 122, the beam shines on the sheet, so that the sheet interrupts the beam. Accordingly, the sheet sensor 134 counts the interruptions of the laser beam 135 in determining the number of sheets collected in a set 20. In a preferred embodiment, a sheet reader 138 is also present. Among other things, the sheet reader 138 can minimize errors in counting sheets. The sheet reader 138 is discussed further below.

Figure 3:
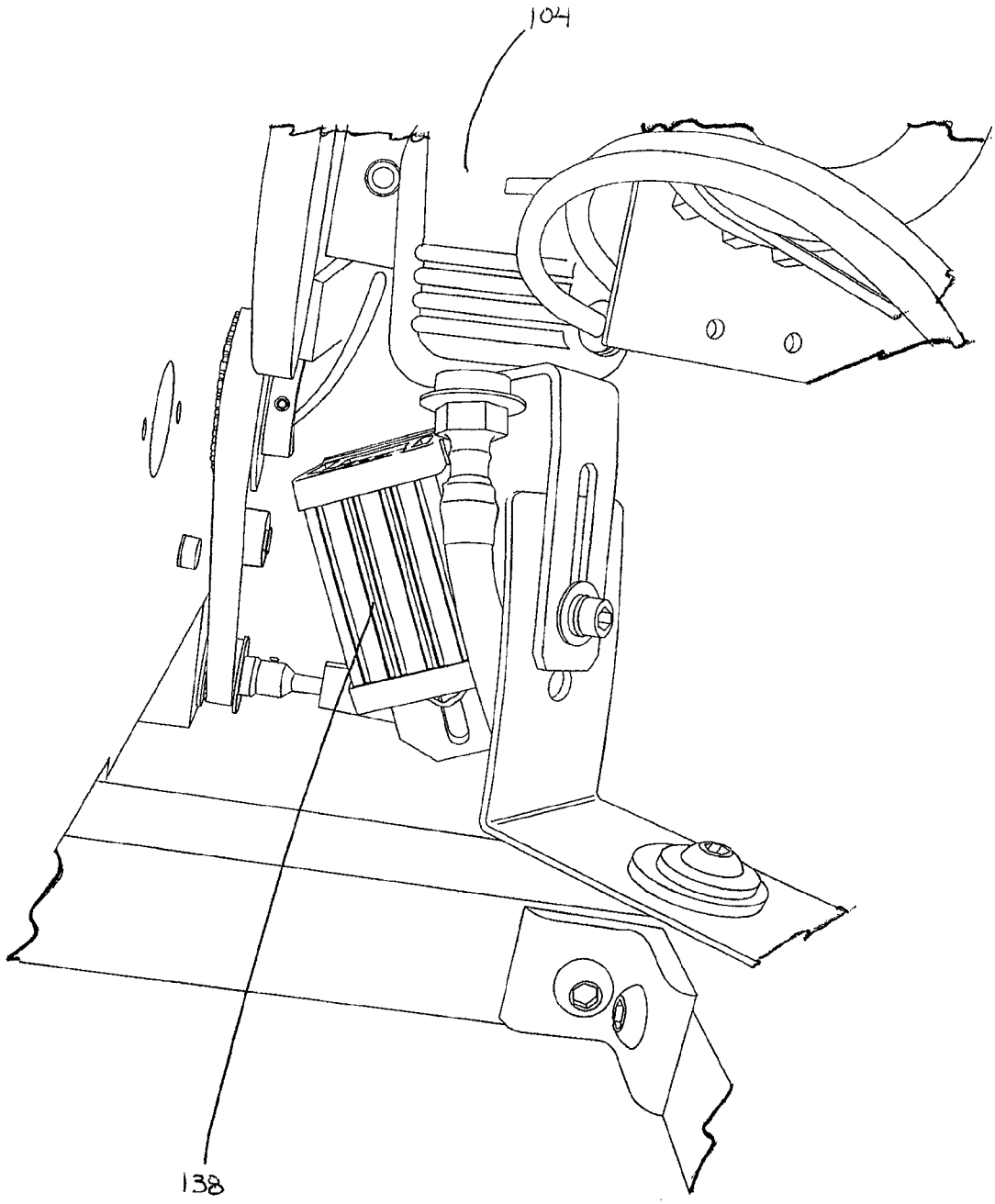
FIG. 3 is an enlarged perspective view of the sheet reader in FIG. 1.

As discussed above and depicted in FIG. 3, another mechanism provided in the apparatus 40 is a sheet reader 138. The sheet reader 138 is located below the sheet sensor 134, the air nozzle 104, and the rotary drum 122. In a preferred embodiment, the sheet reader 138 is a bar code reader 139. Alternatively, the sheet reader may be an optical character recognition device. Also, the sheet reader may be a two-dimensional bar code reader.

The sheet reader 138 scans each piece for particular information, such as a bar code. Each sheet of the stack 30 may be labeled for detection by the sheet reader 138. For instance, if the sheet reader 138 is a bar code detector, then every sheet in the stack 30 could be marked with a bar code along the bottom edge. The bar code could appear on either the front or the back of the sheet. However, it is desirable that the bar code be visible to the sheet reader 138 when the picker 150 pulls the sheet away to expose the lower portion of the sheet to the reader 138. The bar code can be read by the sheet reader on every sheet in the stack. Alternatively, the bar code can be read by the sheet reader 138 for select sheets of a set, such as the lead sheet in a set, or the bar code can be read after a predetermined number of sheets have been counted for a set.

In one embodiment, the sheet reader 138 is a bar code reader, and each sheet in the stack is labeled with a bar code. As the sheet is picked by the picker 150, the bar code on the sheet is exposed to the bar code reader 138. The bar code reader 138 scans the bar code to determine if the sheet belongs in the set. Preferably, the bar code on the sheet describes the location of the sheet in the set. For example, the bar code could show that the sheet is the first in a set. On the other hand, the bar code could indicate that the sheet is the last in the set. By labeling the sequence of the sheet in the set, the bar code reader 138 is another way the apparatus 40 keeps track of the sheets which form a set 20. Alternatively, the sheet could contain some other identifying information aside from its numeric position in the set.

For instance, the bar code could include account information or provide instructions for machine function. By way of example, advertising or marketing information could be encoded on the bar code of the sheet. This data is then used during subsequent processing, such as by adding select documents during subsequent finishing on a separate apparatus. The bar coded information could also be used to determine the amount of postage required if the sheets are ultimately intended to be inserted into an envelope and mailed.

As noted above, the number of augers in the apparatus 40 determines placement of information to be read by the sheet reader 138. Specifically, if only one auger 152 is used, it is desirable to place the bar code on the sheet near the lifted corner. If a second auger 158 is used, the bar code may be placed along the lower edge of the sheet. The second auger 158 allows for a greater range in bar code placement since use of a second auger opens more of the sheet than a single auger 152. Since the second auger 158 allows for more of the lower edge to be visible, the sheet reader 138 can detect information anywhere along the lower edge of the sheet.

As noted above, the number of sheets pre-singulated in the stack can be varied based upon the amount of air blown by the air nozzle 104. Increased air flow is desirable when the rate of sheet feeding increases. In other words, if the stack 30 is advancing towards the pre-singulator 100 at an increased rate, more air flow upon the stack is desired. However, if the amount of air blown from the air nozzle 104 is too great, the sheets could be lifted by the air nozzle 104 over the sheet peeler 120 to interact directly with the auger finger 154. In this scenario, the auger finger 154 might contact the edge of the sheet and cause the sheet to tear. Accordingly, presenting the middle portion of the sheet to the auger finger 154 is desirable to lessen the likelihood of the sheet ripping. In a preferred embodiment, the sheet is pre-singulated enough so that it interacts with the sheet peeler 120 first and then is lifted by the auger finger 154. The sheet peeler 120 presents the sheet to the auger finger 154 in a large bow formation 130 so that the auger finger 154 may contact the middle of the sheet. Alternatively, in some instances it may be desired that the pre-singulated sheet interact directly with the auger finger 154, skipping the rotary drum 122.

Sheet Discharger

Once a predetermined number of sheets are collected by the auger fingers 154, 156 into a set 20, the sheets can be cleared from the apparatus 40. As described above, while the sheets are peeled and processed from the stack 30, only the bottom portion of the sheets is separated from the stack. More specifically, during the peeling and picking process, the sheets are held up against the stack 30 by a plurality of hold-down or retainer elements, such as the pressure plate 70 and the pressure bar 74. During the discharge process, the hold-downs are released so that the set of documents can be removed from the stack 30, as discussed further below.

Figure 10:
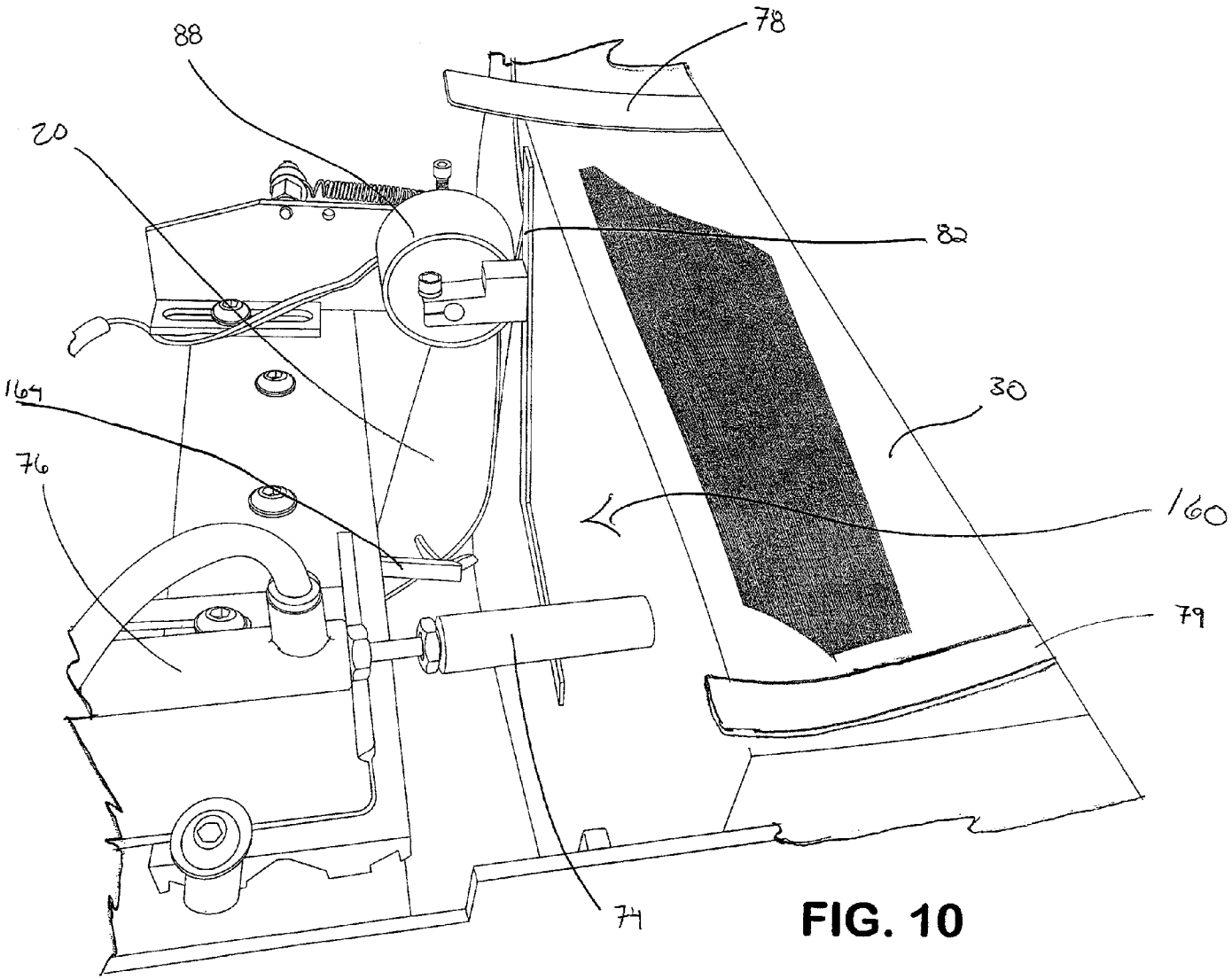
FIG. 10 is a plan view of the sheet discharger.
Figure 11:
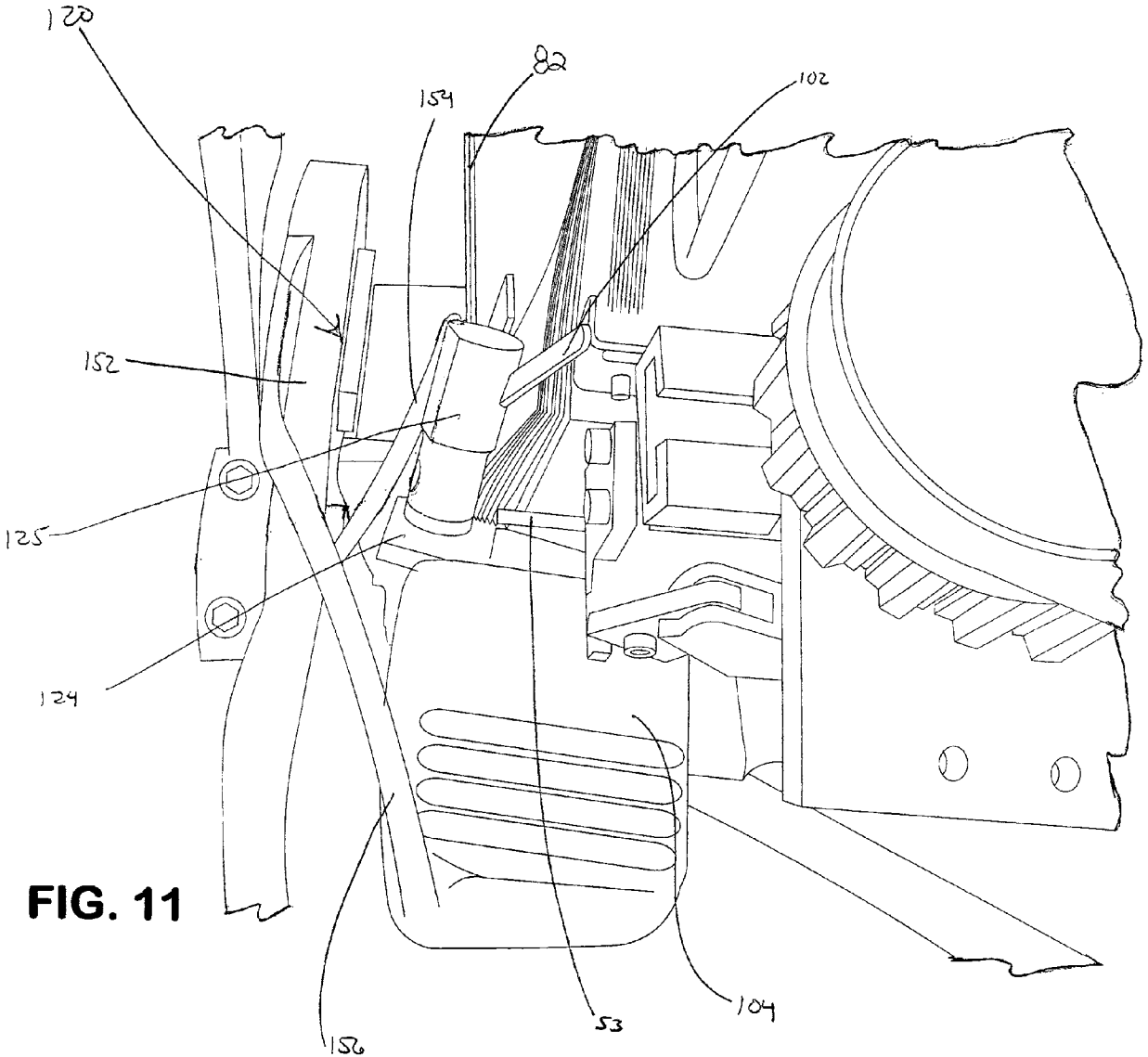
FIG. 11 is an enlarged perspective view of the pre-singulator.

Referring to FIGS. 9-10, the sheet discharger 160 comprises an ejector belt 162 and one or more ejector tabs 164. As discussed above, the sheet picker 150 collects peeled sheets into a set 20 and rests the set on top of a ledge 153. During the peeling and picking process, the stack 30 remains supported by various retainers, including the pressure plate 70, the pressure bar 74, and the bias bar 82. During the discharge process, the pressure plate 70 and the pressure bar 74 move away from the stack 30 to allow the newly formed set 20 to clear the stack. However, when a set 20 of sheets is cleared from the apparatus 40, these retaining elements retract away from the stack 30. As these retaining elements retract, the retaining bracket 102 pivots to hold the stack from the set 20 clearing the apparatus 40. The pivot action of the retaining bracket 102 is discussed further below.

The pressure plate 70 exerts force on the front of the stack 30 along the lower to middle area of the front face of the lead sheet in the stack. When a set 20 of sheets is prepared to be discharged from the sheet processor 25, the pressure plate 70 is displaced away from the stack 30 of sheets. Specifically, the position of the pressure plate 70 is controlled by an air cylinder 72 having a valve. When the air cylinder 72 is actuated into a first condition, the pressure plate 70 is retracted toward the hopper 50 so that the pressure plate is positioned against the lead sheet in the stack of sheets. When the air cylinder 72 is actuated into a second condition, the pressure plate 70 is extended away from the stack 30, creating a gap between the pressure plate 70 and the lead sheet in the stack of documents. By moving away from the stack 30 of sheets, the air cylinder 72 allows the set to be discharged from the sheet processor 25.

In addition to the pressure plate 70, the pressure bar 74 is displaced away from the stack. Referring to FIG. 5, the pressure bar 74 comprises a plunger 76 that is operable in an extended position and a retracted position. In the extended position, the pressure bar 74 is extended toward the hopper 50 so that the end of the pressure bar 74 contacts the lead document in the stack 30. By contacting the lead sheet, the pressure bar 74 applies pressure to the top portion of the front face of the lead sheet in the stack. In this way, the pressure bar 74 supports that top portion of the stack 30, maintaining the position of lead sheet. As described above, the plunger 76 controls the position of the pressure bar 74.

When the set 20 of sheets is ready to clear the apparatus 40, the plunger 76 is actuated to retract the pressure bar 74 to withdraw the pressure bar from the stack. Retracting the pressure bar 74 allows the set to be separate from the front portion on the leading face of the stack. Once the set 20 is cleared from the sheet processor 25, the plunger 76 is actuated again to extend the pressure plate 74 into engagement with the stack 30. Once the pressure plate 74 reengages the stack 30, the pressure plate exerts force against the stack as a new set is formed.

Figure 7:
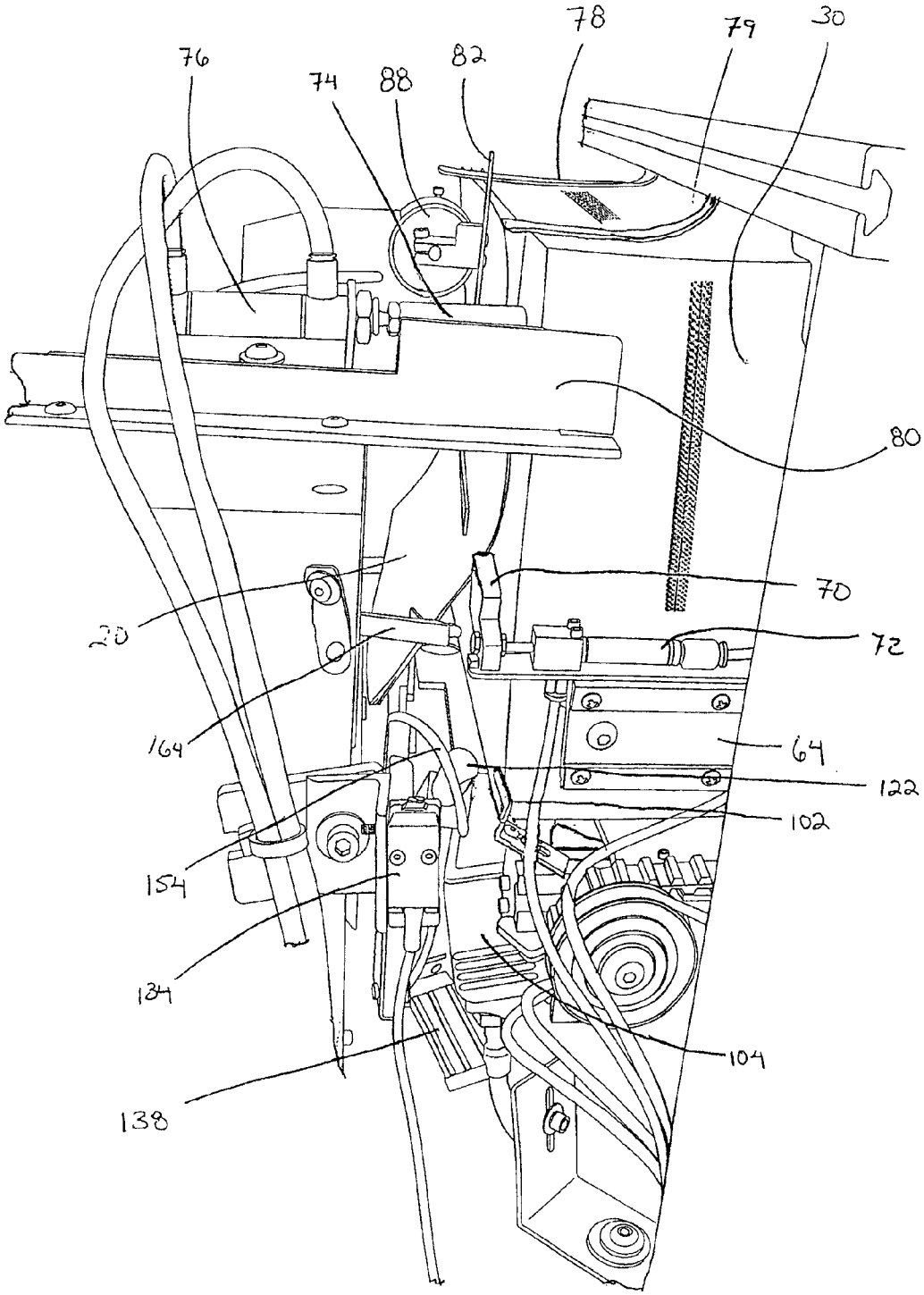
FIG. 7 is an enlarged perspective view of the sheet picker and a set of sheets.

The bias bar 82 is biased toward the stack 30 so that it generally maintains contact with the stack to hold up the front end of the stack while the set is being collected and as the set 20 is being removed from the stack. FIGS. 9 and 10 show the face of the bias bar 82 contacting the stack 30. As depicted in these figures, the bias bar 82 is located in a second position 86. This second position 86 is in contrast to the first position 84 where only a portion of an edge of the bias bar 82 was in contact with the stack. FIG. 7 depicts the set 20 ready for release from the apparatus 40, and the bias bar in the second position 86. When a set 20 is to be discharged, the bias bar 82 is pulled away from the stack 30 by a solenoid 88. The solenoid drives the bias bar rearwardly against the bias in the bias bar, and away from the stack allowing the set to be cleared. See FIG. 7.

Once a set has been completely processed, the vacuum port on the rotary drum 122 is disengaged. Specifically, the vacuum port 126 is disengaged from the vacuum source and no longer produces suction in the gap between the drum head 125 and the stack 30. Simultaneously, an air orifice 126 on the head of the drum 125 engages and blows air into the gap between the drum head and the stack 30. The air orifice impedes further sheets from being peeled from the stack and provides for a more precise sheet count. Additionally, the air blown from the air orifice 126 keeps the next set of sheets back from the rotary drum 122 and also reduces the likelihood of smudges on the next set of sheets.

A motor-driven ejector belt 162 is configured to discharge the set of sheets. The ejector belt 162 is driven by a motor 168. One or more push tabs 164 are mounted on the ejector belt 162. When the ejector belt 162 is displaced forwardly, the tab 164 is displaced toward the discharge area toward the backside of the apparatus 40. As the ejector tab 164 is displaced toward the discharge area, the ejector tab 164 engages the edge of the set of sheets resting on the ledge 153 on the augers. The continued displacement of the ejector tab 164 displaces the set 20 of sheets rearwardly to discharge the set. Although the ejector 162 is illustrated as having a single ejector tab 164, it may be desirable to include two or more ejector tabs to engage and discharge the set of sheets.

As the set 20 of sheets is removed from the stack 30 and discharged, the retainer bracket 102 holds the stack of sheets away from the ejector tab 164. Specifically, the retainer bracket is pivotable about a pivot point 172, between first and second positions. During counting and separation of a set, the retainer bracket is pivoted to an open position, as shown in FIG. 8. During the ejection process, the retainer bracket pivots to a closed position in which the bracket pivots toward the stack, as shown in FIG. 7. The retainer bracket 102 is connected to an air valve, which is actuable to provide pneumatic force to drive the bracket between the first and second positions. When a set 20 of sheets is ejected from the apparatus 40, friction between the sheets can cause drag. When the bracket 102 is pivoted to the closed position, the bracket holds the stack together to prevents the next set 20 of sheets from getting pulled away as the previous set is cleared from the apparatus 40.

Generally, a relatively low amount of friction is used to process the sheets into sets. Specifically, the use of the rotary head and auger reduces or eliminates the need to frictionally engage each sheet with rollers or other frictional elements to separate the sheets from the stack. One way the effects of friction are decreased is by use of an auger finger 154. The auger finger 154 slides through the large bow 130 to move the sheet onto the ledge 153. Optionally, friction between the auger and the sheets can be further removed by incorporating air jets into the auger. The air jets provide a cushion of air along auger fingers to reduce the friction. Incorporating such an air cushion may be particularly desirous in applications in which color printing is printed onto the sheets Once the sheets are combined into a set 20, the set proceeds towards an output bin. The output bin may include an envelope filler. Since the distance over which the sheets move as they are processed by the sheet processor 25 and the sheet discharger 160 is small, the sheets can move very quickly. Further, since the set 20 of sheets is discharged at one time, the sheets do not need time to recombine, or settle, before being placed into envelopes.

As mentioned above, although the embodiment described above includes a sheet peeler, there are applications where sheets can be processed without a rotary drum 122. In such an instance, the sheets are processed by the pre-singulator and then picked by the auger finger 154. The pre-singulator 100 has precise control over the separation of a portion of the sheets towards the leading face of the stack. Specifically, the pre-singulator 100 creates enough of a space between the sheets so that the auger finger 154 can grab the sheets. The auger 152 may operate at a slower speed when engaging the pre-singulated sheets. The slower speed minimizes damage to the sheets.

Use of the Apparatus

Described below is an exemplary use of the apparatus.

First, a stack 30 of sheets is placed in the hopper 50. The stack 30 rests on a base plate 53. To support the trailing end of the stack 30, a driver 52 is positioned against the trailing end of the stack 30. The driver 52 is connected with the vertical post 57, which engages the toothed belt 54. To position the driver 52, the dog of the vertical post 57 is disengaged from the toothed belt 54. Specifically, the dog is retracted or displaced away from the toothed belt 54, which allows the vertical post 57 to be manually displaced relative to the toothed belt. Accordingly, after the dog is retracted, the vertical post 57 and attached driver 52 are displaced so that the push plate 68 of the driver 52 engages the rearward end of the stack 30 of sheets.

After the stack 30 is loaded in the hopper 50 the dog on the vertical post 57 is extended into engagement with the toothed belt 54 to retain the vertical post and accompanying driver 52 in a fixed position relative to the toothed belt. The position of the toothed belt 54 is controlled by the operation of the drive motor 62. If the first sensor does not detect the leading edge of the stack 30, the controller controls the operation of the motor 62 by starting the motor. The motor 62 turns the drive belt 58, which drives the toothed belt 54, which in turn drives the driver 52, thereby displacing the stack 30 forwardly toward the sheet processor 25. Once the first sensor 90 detects the leading edge of the stack 30, the controller 55 controls the operation of the motor 62 by slowing the motor, thereby slowing the rate at which the driver 52 drives the stack toward the sheet processor 25.

As the leading edge of the stack 30 approaches the sheet processor 25 a plurality of elements engage the lead sheet in the stack to position and retain the leading edge of the stack. First, a bias bar 82 biased toward the stack engages the lead sheet, toward the top portion of the front face of the lead sheet. Additionally, an air-actuated pressure bar 74 extends forwardly to engage a top portion of the front fact of the lead sheet. Further, a pressure plate 70 retracts to engage a lower portion of the front face of the lead sheet. In the present instance, the pressure plate 70 engages the lead sheet on a portion of the front face toward the right side of the front face of the lead sheet. In this way, when the stack 30 is adjacent to the sheet processor 25, the stack is retained at numerous points to impede separation of the sheets from the stack. However, the lower edge of the sheets in the stack 30 is generally free so that the lower edges of the sheets can be pulled away from the stack.

As the stack 30 progresses toward the sheet processor 25, the bias bar 82 moves with the front edge of the stack. On the other hand, the pressure bar 74 and pressure plate 70 are controlled to remain at a fixed position relative to the lead sheet until the set of sheets are to be discharged from the sheet processor 25 as described below.

Once the stack 30 is positioned adjacent the sheet processor 25, the lower portion of a number of sheets are pulled away from the stack so that the sheets can be removed from the stack to form a set 20. To pull the sheets away from the stack, a lower corner of the sheets are peeled away from the stack. To facilitate the peeling process, a pre-singulator 100 is provided to create some separation between the lead sheets in the stack.

The pre-singulator 100 directs air toward the lower edge of the stack of sheets. The stream of air blows the sheets away from one another, creating spaces between the sheets. Pre-singulation of the sheets causes the sheets to form a small bow 128 formation. In the present instance, the stream of air is directed so that the air blows the sheets away from the stack, and toward a sheet peeler 120. A retainer bracket 102 positioned near the lower edge of the stack 30 adjacent the front side of the apparatus 40 holds back the corner of the sheets as the sheets are blown toward the sheet peeler 120. The retainer bracket 102 holds the sheets back and maintains the small bow 128 formation.

The sheet peeler 120 comprises a rotary drum 122 having a vacuum port 126. As shown in FIG. 5, the sheet peeler 120 is positioned adjacent the lower right-hand corner of the front face of the lead sheet in the stack 30. As the rotary drum 122 rotates, vacuum from the vacuum port 126 draws the lead sheet of the stack 30 up against the rotary head 125 and holds the sheet against the rotary drum 122. The rotary drum 122 rotates away from the stack 30, with the corner of the lead sheet entrained against the rotary drum 122 by the vacuum. As the peeler 120 pulls the lead sheet away from the stack 30, the retaining bracket 102 retains the corner of the lead sheet. In this way, as the peeler 120 pulls the lead sheet away, the lower corner of the lead sheet forms a large bow 130 as the retaining bracket 102 retains the corner of the sheet. The large bow 130 forms a gap between the lead sheet and the next sheet in the stack 30.

The sheet picker 150 pulls the lower portion of the lead sheet away from the stack 30 after the peeler 120 has peeled the area near the lower corner of the lead sheet away from the stack. Specifically, the auger 152 of the sheet picker rotates an elongated finger 154 into the gap created between the large bowed sheet 130 and the rest of the stack 30. As the auger 152 rotates, the finger 154 slides between the first two sheets in the stack. Since the finger 154 curves away from the stack 30, the finger pulls the sheet away from the stack and moves the lower edge of the sheet onto the ledge 153 on top of the auger 152, as the auger rotates. Additionally, as the auger finger 154 pulls the sheet away from the stack 30, the auger finger 154 also pulls the sheet away from the rotatable drum 122. The drum 122 continues to rotate around, until the vacuum port 126 of the drum is adjacent the stack so that the drum can engage the lower portion of the next sheet in the stack 30, thereby starting the peeling process with the next sheet. In this way, the picker 150 and peeler 120 continue to rotate and pull the lower edge of sheets away from the stack and set the lower edge on the ledge 153 on the auger 152.

As the lower portion of each sheet is pulled away from the stack, the sheet is counted by a sheet sensor 134. Additionally, each sheet may be scanned by a sheet reader 138 that scans the sheets as they are pulled away. The reader 138 may scan for various features on one or more sheets in the stack, such as a bar code or a series of characters. Once the sheet sensor 134 has determined that a pre-determined number of sheets have been pulled away from the stack 30, the set of removed documents is the removed from the stack and ejected from the sheet processor 25. Alternatively, rather than determining that the set 20 of documents is ready for ejection based on the number of sheets counted, the determination may be made based on a characteristic on the sheet. For instance, a bar code may be printed on the end sheet in each set of sheets. Once the sheet reader 138 detects the barcode, the controller 55 may indicate that the sheet is the last sheet in the set and then cause the set 20 to be ejected.

Once a number of sheets have been identified as comprising a complete set, based on either the number of documents or some other criteria, as described above, the set 20 is ejected from the sheet processor 25. In order to eject the set, various items that retain the stack are released, to allow the entire sheets to be pulled off of the stack 30. Specifically, an air cylinder 72 is actuated to displace the pressure plate 70 away from the lower portion of the stack 30, and a plunger 76 is actuated to displace the pressure bar 74 away from the upper portion of the stack. A solenoid 88 displaces the bias bar 82 rearwardly to withdraw from the stack. As the bias bar 82 withdraws from the stack, the bias bar moves from a second position into a first position. However, the retaining bracket 102 pivots to hold the lower right corner of the stack in place as the newly formed set clears.

After the retainers disengage the stack, the discharger 160 discharges the set 20 of sheets. Specifically, an ejector belt 162 drives an ejector tab 164 against the side edges of the lower portion of the sheets that were pulled away from the stack 30. The ejector tab 164 drives the separated sheets rearwardly toward a discharge area, away from the stack. The force of the ejector tab 164 against the edges of the documents is sufficient to overcome the friction between the set being cleared from the apparatus and the lead sheet in the next set 20.

After the set 20 of sheets is discharged from the sheet processor 25, the air cylinder 72 displaces the pressure plate 70 back toward the stack 30 of sheets and the plunger 76 is actuated to displace the pressure bar 74 back toward the stack to support and hold the sheets in the stack. The bias bar moves from a first position 84 into a second position 86 as the stack advances and pushes against the bias bar. The sheet peeler 120 engages the new lead sheet in the stack 30 to start the process of removing the next set of sheets from the stack. The process of peeling, picking, and ejecting sets of sheets is continued until the sheets in the hopper 50 are processed or the operator intervenes.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. An apparatus for separating a stack of sheets into sets of sheets, comprising:

(a) an input area for receiving the stack of sheets to be processed;

(b) a feeder for processing the stack of sheets, wherein the feeder includes:

(i) a sheet separator operable to create a gap between a first portion of a first sheet from the stack of sheets while a second portion of the first sheet maintains contact with the stack; and (ii) an accumulator operable to separate a pre-determined number of sheets from the stack to form a set of sheets, wherein the accumulator includes a rotatable arm, and wherein rotation of the arm increases the gap between the first portion and the stack to separate the first portion of the sheet from the stack of sheets; and (c) a discharger for removing the set of sheets from the stack of sheets after the set is separated by the accumulator.

2. The apparatus of claim 1, wherein the sheet separator comprises an air nozzle capable of directing air from an air source onto the stack of sheets to separate the first portion of the first sheet from the stack of sheets while the second portion of the first sheet maintains contact with the stack.

3. The apparatus of claim 1, wherein the input area includes a retainer positioned along an edge of the stack for stabilizing the stack of sheets while sets of sheets are processed.

4. The apparatus of claim 1, wherein the rotatable arm comprises a tip angled toward the stack of sheets.

5. The apparatus of claim 1, wherein the discharger includes a controller operable to determine the number of sheets separated from the stack and to control operation of the discharger when the number of sheets separated from the stack reaches a pre-determined number.

6. The apparatus of claim 1, comprising:

(a) a reader for detecting data displayed on the first sheet; and (b) a processor for comparing the detected data to a pre-determined parameter.

7. The apparatus of claim 1, wherein the feeder includes a rotary drum for contacting each sheet in a set of sheets, wherein the rotary drum includes a vacuum source for providing a suction force to attract a first portion of each sheet towards the rotary drum.

8. The apparatus of claim 7 wherein the feeder includes a retainer for retaining a second portion of each sheet in the set of sheets, wherein the retainer retains a portion of an edge of the sheet so that the first portion of the sheet forms a bow when the rotary drum attracts the first portion.

9. The apparatus of claim 8, wherein rotation of the rotary drum enlarges the bow in each sheet.

10. The apparatus of claim 1, comprising a pair of augers.

11. The apparatus of claim 10, wherein each auger includes a pair of rotating arms.

12. The apparatus of claim 10, wherein the pair of augers rotate in the same direction.

13. The apparatus of claim 10, wherein:

(a) the first auger separates a part of the first portion of each sheet from the stack; and (b) the second auger separates a second part of the first portion.

14. An apparatus for creating sets of sheets from a stack of sheets, comprising:

(a) an input area for receiving a stack of sheets;

(b) a feeder comprising:

(i) a separator operable to separate part of a first sheet from a second sheet;

(ii) a singulator operable to bend a portion of the first sheet away from the stack, while a second portion of the first sheet maintains contact with the stack;

(iii) a sheet lifter for lifting the first portion of the first sheet away from the stack, while the second portion of the first sheet maintains contact with the stack; and (c) a discharger for discharging sheets from the feeder.

15. The apparatus of claim 14, wherein the singulator includes a rotary drum for contacting the first sheet, wherein the rotary drum displaces the first sheet from the stack to form a gap between the first portion of the first sheet and the stack of sheets.

16. The apparatus of claim 15, comprising a retainer, wherein the retainer retains the first portion of the first sheet so that the first portion forms a bow when the rotary drum attracts the first portion.

17. The apparatus of claim 14, wherein the sheet lifter includes an auger having an arm, wherein the arm contacts a face of the first portion of the first sheet to increase a gap separating the first portion of the first sheet from the stack of sheets.

18. The apparatus of claim 17, wherein the auger separates a pre-determined number of sheets from the stack to form a set of sheets in the stack.

19. The apparatus of claim 14, comprising:

(a) a reader for detecting data displayed on the first sheet; and (b) a processor for comparing the detected data to a pre-determined parameter.

20. An apparatus for processing documents, comprising:

an input for receiving a stack of documents;

a feeder for feeding the documents, wherein the feeder comprises a separator for displacing a first portion of the document away from the stack, a retainer engaging the document to impede displacement of a second portion of the document away from the stack, wherein force of the retainer on the second portion of the document causes the first portion of the document to curve away from the stack of documents when the feeder displaces the first portion.

21. The apparatus of claim 20 wherein the retainer is positioned along a leading edge of the stack so that the retainer causes the leading edge of the document to curve away when the separator displaces the first portion of the document, thereby forming a gap between the first portion and the stack.

22. The apparatus of claim 21 wherein the retainer is positioned at a corner of the document to retain a corner of the document as the separator displaces the first portion of the document.

23. The apparatus of claim 20 wherein the sheet separator comprises a nozzle providing a stream of gas directed at the first portion to provide separation between the first portion of the document and the stack.

24. The apparatus of claim 23 wherein the feeder comprises a rotary element operable to engage the first portion of the document, wherein the rotary element rotates away from the stack to create a gap between the first portion and the stack.

25. The apparatus of claim 24 wherein the feeder comprises a vacuum source operable to draw the first portion of the document toward the rotary element.

26. The apparatus of claim 20 wherein the feeder comprises a rotatable arm operable to engage the first portion after the separator displaces the first portion, wherein the rotatable arm displaces the first portion away from the stack so that the first portion is retained spaced apart from the stack while the second portion remains in the stack.

27. The apparatus of claim 26 wherein the feeder is configured so that the rotatable arm displaces the first portion of a plurality of documents away from the stack while the second portion of each of the plurality of documents is retained in the stack.

28. The apparatus of claim 27 comprising an ejector for ejecting the plurality of documents from the stack substantially simultaneously to form a set.

29. An apparatus for separating a stack of sheets into sets of sheets, comprising:

(a) an input for receiving the stack of sheets to be processed;

(b) a sheet processor for processing the stack of sheets from the input, wherein the sheet processor includes:

(i) a sheet peeler operable to create a gap between a first portion of a top sheet and the stack of sheets and a next successive sheet in the stack to provide a gapped top sheet; and (ii) a sheet picker operable to separate a portion of the gapped top sheet from the stack to a position for accumulation to enable at least a portion of the next successive sheet in the stack to be presented to the sheet peeler as a next top sheet to be gapped by the sheet peeler and then separated by the sheet picker until a selected number of sheets are accumulated to form a set of sheets; and (c) a discharger for removing the accumulated set of sheets from the stack of sheets.

30. The apparatus of claim 29, wherein the sheet peeler separates a first portion of the top sheet while a second portion of the top sheet maintains contact with the stack.

31. The apparatus of claim 30, wherein the sheet peeler includes a rotary drum for displacing the top sheet relative to the stack, so that the first portion of the top sheet forms a gap relative to the stack of sheets.

32. The apparatus of claim 29, wherein the sheet picker separates a first portion of a top sheet while a second portion of the top sheet maintains contact with the stack.

33. The apparatus of claim 32, wherein the sheet picker includes an auger having at least one finger for accumulating sheets into sets.

* * * * *